US009728115B2

(12) United States Patent
Miyata et al.

(10) Patent No.: US 9,728,115 B2
(45) Date of Patent: Aug. 8, 2017

(54) LIQUID CRYSTAL DISPLAY DEVICE AND DATA CORRECTION METHOD IN LIQUID CRYSTAL DISPLAY DEVICE

(71) Applicant: Sharp Kabushiki Kaisha, Osaki-shi, Osaka (JP)

(72) Inventors: Hidekazu Miyata, Osaka (JP); Takatomo Yoshioka, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 37 days.

(21) Appl. No.: 14/785,895

(22) PCT Filed: Feb. 18, 2014

(86) PCT No.: PCT/JP2014/053690
§ 371 (c)(1),
(2) Date: Oct. 21, 2015

(87) PCT Pub. No.: WO2014/185109
PCT Pub. Date: Nov. 20, 2014

(65) Prior Publication Data

US 2016/0071449 A1 Mar. 10, 2016

(30) Foreign Application Priority Data

May 13, 2013 (JP) ..... 2013-101578

(51) Int. Cl.
*G09G 3/20* (2006.01)
*G09G 3/36* (2006.01)

(52) U.S. Cl.
CPC ..... *G09G 3/2003* (2013.01); *G09G 3/3607* (2013.01); *G09G 2310/0235* (2013.01); *G09G 2310/08* (2013.01)

(58) Field of Classification Search
CPC ..... G09G 3/3607; G09G 3/2003; G09G 2310/0235; G09G 2310/08; G09G 3/20;
(Continued)

(56) References Cited

U.S. PATENT DOCUMENTS

2004/0119995 A1* 6/2004 Nishi ..... H04N 1/6027 358/1.9
2005/0041047 A1* 2/2005 Miyata ..... G09G 3/3611 345/690
(Continued)

FOREIGN PATENT DOCUMENTS

JP 07-121138 A 5/1995
JP 2007-017862 A 1/2007
(Continued)

OTHER PUBLICATIONS

Official Communication issued in International Patent Application No. PCT/JP2014/053690, mailed on Apr. 8, 2014.

*Primary Examiner* — MD Saiful A Siddiqui
(74) *Attorney, Agent, or Firm* — Keating & Bennett, LLP

(57) ABSTRACT

A liquid crystal display device of the field sequential system is realized that is capable of suppressing an occurrence of a color shift.

The liquid crystal display device of the field sequential system includes a minimum responsive color difference data correction unit (122) that corrects a data value of pixel data of a color outside a displayable range to a value of a color in the displayable range, a tristimulus value-digital gradation value conversion unit (124) that converts the corrected pixel data to digital gradation data, and a digital gradation data correction unit (126) that performs a correction for over driving on the digital gradation data. The minimum responsive color difference data correction unit (122) determines a color in an uniform color space such that the color is within the displayable range and the color has a smallest color difference from an original uncorrected color, converts data representing the determined color to data represented in the RGB color space, and employs the resultant converted data as the corrected data value of the pixel data.

14 Claims, 22 Drawing Sheets

(58) Field of Classification Search
CPC ..... G09G 3/3406; G09G 2320/0646; G09G 2360/16; G09G 2330/021; G09G 2320/064; G09G 2320/0276; G09G 2320/0626; G09G 3/3648; G09G 3/3611
See application file for complete search history.

(56) References Cited

U.S. PATENT DOCUMENTS

| | | | | |
|---|---|---|---|---|
| 2008/0112026 | A1 | 5/2008 | Kishimoto | |
| 2011/0128438 | A1 | 6/2011 | Yamashita et al. | |
| 2012/0002133 | A1* | 1/2012 | Yamazaki | G09G 3/342 349/61 |
| 2012/0069062 | A1* | 3/2012 | Ishihara | G09G 3/3611 345/690 |

FOREIGN PATENT DOCUMENTS

| | | | |
|---|---|---|---|
| JP | 2008-148275 | A | 6/2008 |
| WO | 2010/023884 | A1 | 3/2010 |

* cited by examiner

127

FIELD-BEING-DISPLAYED VALUE

PREVIOUS FIELD VALUE

| | 0 | 32 | 64 | 96 | 128 | 160 | 192 | 224 | 255 |
|---|---|---|---|---|---|---|---|---|---|
| 0 | 0 | 48 | 96 | 152 | 196 | 220 | 248 | 255 | 255 |
| 32 | 0 | 32 | 80 | 134 | 172 | 203 | 239 | 255 | 255 |
| 64 | 0 | 28 | 64 | 110 | 149 | 192 | 232 | 252 | 255 |
| 96 | 0 | 25 | 58 | 96 | 132 | 181 | 224 | 248 | 255 |
| 128 | 0 | 21 | 49 | 83 | 128 | 165 | 219 | 245 | 255 |
| 160 | 0 | 19 | 45 | 74 | 122 | 160 | 208 | 243 | 255 |
| 192 | 0 | 18 | 39 | 68 | 114 | 142 | 192 | 241 | 255 |
| 224 | 0 | 17 | 34 | 61 | 108 | 130 | 181 | 224 | 255 |
| 255 | 0 | 16 | 32 | 58 | 102 | 124 | 172 | 210 | 255 |

LIQUID CRYSTAL DISPLAY DEVICE AND DATA CORRECTION METHOD IN LIQUID CRYSTAL DISPLAY DEVICE

TECHNICAL FIELD

The present invention relates to a liquid crystal display device, and more particularly, to a technique to suppress an occurrence of a color shift in a liquid crystal display device of a field sequential system.

BACKGROUND ART

In a liquid crystal display device capable of displaying a color image, in general, each pixel is divided into three sub-pixels: a red color pixel provided with a color filter that allows red color light to pass through; a green color pixel provided with a color filter that allows green color light to pass through; and a blue color pixel provided with a color filter that allows blue color light to pass through. The provision of the color filters on the respective three sub-pixels makes it possible to display color images. However, the color filters absorb as much as about two thirds of backlight incident on a liquid crystal panel. This results in a problem that the liquid crystal display device of the color filter type is low in light use efficiency. Thus, a liquid crystal display device of a field sequential system in which a color is displayed without using a color filter has attracted attention.

In general, in the liquid crystal display device using the field sequential system, one frame period in which one screen is displayed is divided into three fields. Note that although the field is also called a subframe, the field is used as the term throughout all the following description. For example, one frame period is divided into a field (red color field) in which a red color screen is displayed based on a red color component of an input image signal, a field (green color field) in which a green color screen is displayed based on a green color component of the input image signal, and a field (blue color field) in which a blue color screen is displayed based on a blue color component of the input image signal. By displaying the primary colors alternately such that one of the primary colors is displayed at a time as described above, a color image is displayed on a liquid crystal panel. In the liquid crystal display device of the field sequential system, the color image is displayed in the above-described manner, and thus the color filters are unnecessary. Therefore, in the liquid crystal display device of the field sequential system, it is possible to achieve light use efficiency about three times higher than that achieved by the liquid crystal display device of the color filter type. Therefore, the liquid crystal display device of the field sequential system is suitable for increasing luminance or reducing power consumption.

Note that in the present description, a combination of a data value of a red color component, a data value of a green color component, and a data value of a blue color component is referred to as an "RGB combination". For example, "R=128, G=32, B=255" is an example of an RGB combination. In this example, the data value of the red color component is 128, the data value of the green color component is 32, and the data value of the blue color component is 255. The data value is typically given by a gradation value.

In the liquid crystal display device, an image is displayed by controlling a transmittance of each pixel by controlling a voltage (a voltage applied to the liquid crystal). Regarding this, as illustrated in FIG. 22, it takes several milliseconds for the transmittance to reach a target transmittance after writing of data into a pixel (application of a voltage) is started. Therefore, in the liquid crystal display device of the field sequential system, in each field, backlight of a color corresponding to the field is switched from an off-state to an on-state after the liquid crystal has responded to a certain degree. That is, in the liquid crystal display device of the field sequential system, the backlight is in the on-state only during a part of a second half period of each field (for example, during a period denoted by a symbol T9 in FIG. 22).

Furthermore, in the liquid crystal display device, there is a possibility that a slow response of a liquid crystal makes it difficult to obtained a high image quality, for example, when a moving image is displayed. To handle the low response of the liquid crystal, it is known to use a driving method called over driving (overshoot driving). In the over driving method, depending on a combination of a data value of an input image signal of an immediately previous frame and a data value of an input image signal of a current frame, a driving voltage higher than a gradation voltage predetermined for the data value of the input image signal of the current frame or a driving voltage lower than the gradation voltage predetermined for the data value of the input image signal of the current frame is applied to the liquid crystal panel. That is, the over driving allows the input image signal to be corrected such that a temporal change (not a spatial change) of the data value is emphasized. In the liquid crystal display device of the color filter type, the over driving is performed such that the liquid crystal responds so as to reach the target transmittance within each frame.

In relation to the present invention, Japanese Unexamined Patent Application Publication No. 7-121138 discloses a technique related to a liquid crystal display device of the field sequential system. In the technique disclosed in Japanese Unexamined Patent Application Publication No. 7-121138, the timing of scanning a time-division three primary color light emission device is delayed by an amount corresponding to an optical response time of a liquid crystal, and there is provided a no-light-emission period corresponding to the optical response time of the liquid crystal. Furthermore, when data is written to a pixel, a gamma correction is performed depending on a result of a comparison between data of a previous field and data of a current field.

CITATION LIST

Patent Literature

PTL 1: Japanese Unexamined Patent Application Publication No. 7-121138

SUMMARY OF INVENTION

Technical Problem

In the liquid crystal display device of the field sequential system described above, one frame period is divided into three fields and thus the length of a period during which data is written into each pixel is one-third of that allowed for the liquid crystal display device of the color filter type. As a result, even in a case where the over driving is employed, there is a possibility that a target transmittance is not reached within one field depending on a magnitude of a change in a data value of an input image signal relative to that of a previous field as illustrated in FIG. 23 (see part denoted by reference numeral 90). This will be described in further detail below. In a liquid crystal display device of a currently widely used type, a source driver is used which is capable of outputting only voltages corresponding to gradation values in a range, for example, from 0 to 255. That is, the source driver provided in the liquid crystal display device of the currently widely used type, is not capable of outputting an extended voltage (other than the voltages corresponding to the gradation value in the range from 0 to 255). Therefore, for example, in a case where a gradation value in a previous field is 0, and a gradation value in a current field is 255, it is impossible to correct the gradation voltage so as to increase the response speed of the liquid crystal. As a result, as illustrated in FIG. 23, a target transmittance is not reached within one field. If it is tried to configure the source driver so as to be capable of outputting an extended voltage, it is necessary to reduce the number of gradation values allowed to be displayed. This results in a reduction in display luminance.

Furthermore, from the point of view of the "step response of the liquid crystal", it is difficult for the target transmittance to be reached within one field. The "step response of the liquid crystal" is described further. When data is written to a pixel, a pixel forming part turns on/off a TFT (a pixel TFT). When the TFT is turned off, an electric charge accumulated at a pixel electrode is maintained. However, because the response of the liquid crystal is not completed in a very short period, the liquid crystal continues to respond to an electric field even after the TFT changes from the on-state to the off-state. Here, there is a relationship represented as "Q=CV" among an electric charge Q, capacitance C, and a voltage V. If the liquid crystal responds after the TFT turns off, the capacitance C between electrodes changes, and the voltage V also changes such that the relationship "Q=CV" is satisfied. Therefore, performing writing to the pixel only once cannot allow the liquid crystal to respond to a degree that allows the target transmittance to be achieved. Thus, in the liquid crystal display device of the color filter type, the liquid crystal seems to respond over a few frames. The response of the liquid crystal over a few frames is called the "step response of the liquid crystal".

In a case where a still image is displayed on a liquid crystal display device of the color filter type, after the image is once displayed, the liquid crystal is maintained in a fixed state (without no change) over a period until another image is displayed. Therefore, the response characteristic of the liquid crystal has a relatively small influence on display quality. In contrast, in the liquid crystal display device of the field sequential system, the gradation value changes from one field to another except that no color is displayed. Therefore, in general, the state of the liquid crystal changes from one field to another. Furthermore, in the liquid crystal display device of the field sequential system, as described above, the target transmittance is not often reached in each field before a next field starts because of the fact that each frame is divided into a plurality of fields (for example, three fields) and because of the step response of the liquid crystal. As a result, in the liquid crystal display device of the field sequential system, a color shift occurs frequently when a color image is displayed.

Now, referring to FIG. 24 to FIG. 26, a description is given below as to a phenomenon that occurs when images respectively of white, red, and yellow are displayed on the liquid crystal display device of the field sequential system. Note that it is assumed herein that this liquid crystal display device is capable of displaying 256 gradation levels, and one frame period includes a red color field, a green color field, and a blue color field. Furthermore, in FIG. 24 to FIG. 26, "MIN" represents a transmittance corresponding to gradation value 0, and "MAX" represents a transmittance corresponding to gradation value 255. When a white image is displayed, the liquid crystal is maintained in a constant state as shown in FIG. 24. Thus, no color shift occurs while the white image is displayed. When a red image is displayed, the state of the liquid crystal changes as shown in FIG. 25. In the red color field, a large change in gradation value occurs at a transition from the previous blue color field, and thus the target transmittance is not reached as represented by reference numeral 91. As a result, the red color is not displayed at a desired luminance. In the green color field, a large change in gradation value occurs at a transition from the red color field, and thus the target transmittance is not reached as represented by reference numeral 92. As a result, a green color is displayed although the green color should not be displayed. As described above, a color shift occurs when the red image is displayed. When a yellow image is displayed, the state of the liquid crystal changes as shown in FIG. 26. In the red color field, a large change in gradation value occurs at a transition from the previous blue color field, and thus the target transmittance is not reached as represented by reference numeral 93. Therefore, the red color is not displayed at a desired luminance. In the blue color field, a large change in gradation value occurs at a transition from the green color field, and thus the target transmittance is not reached as represented by reference numeral 94. As a result, a blue color is displayed although the blue color should not be displayed. As described above, a color shift occurs when the yellow image is displayed.

As described above, in the liquid crystal display device of the field sequential system, a color shift occurs when an image is displayed which includes a color of an RGB combination (for example, a combination of "R=255, G=0, B=0" illustrated in FIG. 25) for which a target transmittance is not reached within one filed. In a schematic illustration, for example, when a color should be displayed in a manner as represented by reference numeral 97 in FIG. 27, the color is displayed in a manner as represented by reference numeral 98 in FIG. 27.

In view of the above, an object of the present invention is to realize a liquid crystal display device of the field sequential system capable of suppressing an occurrence of a color shift.

Solution to Problem

In a first aspect, the present invention provides a liquid crystal display device of the field sequential system, configured to display a color by dividing one frame period into a plurality of fields and displaying different colors in the respective fields, including a liquid crystal panel configured to display an image, an RGB data correction unit configured to receive pixel data that is data represented in an RGB color space and indicating a color of each pixel, and correct a data value of pixel data such that when a color given by a combination of R, G, and B is incapable of being displayed on the liquid crystal panel by the field sequential system, the data value thereof is corrected to a data value of a color given by a combination of an R, G, and B capable of being displayed on the liquid crystal panel by the field sequential system, a data conversion unit configured to convert the pixel data corrected by the RGB data correction unit to digital gradation data capable of being input to the liquid crystal panel for each field, a digital gradation data correction unit configured to correct the digital gradation data obtained in the data conversion unit so as to emphasize a temporal change in a data value, and a liquid crystal panel driving unit configured to drive the liquid crystal panel based on the digital gradation data corrected by the digital gradation data correction unit, wherein the RGB data correction unit converts the pixel data represented in the RGB color space to data represented in an uniform color space, determines a color capable of being displayed in the uniform color space by the field sequential system such that the color has a smallest color difference from the original uncorrected color, converts the data representing the determined color to data represented in the RGB color space, and employs a resultant value obtained as a result of the conversion as a corrected data value of the pixel data.

In a second aspect of the present invention, based on the first aspect of the present invention, when an arbitrary field of the plurality of fields is defined as a field of interest, a data value of digital gradation data corresponding to the field of interest is defined as a value of the field being displayed, and a data value of digital gradation data corresponding to a field immediately previous to the field of interest is defined as a previous field value, the digital gradation data correction unit corrects the value of the field being displayed obtained in the data conversion unit depending on the previous field value obtained in the data conversion unit.

In a third aspect of the present invention, based on the second aspect of the present invention, the liquid crystal display device further includes a field memory capable of storing one field of digital gradation data corresponding to a last field in each frame period in the digital gradation data obtained in the data conversion unit.

In a fourth aspect of the present invention, based on the second aspect of the present invention, the liquid crystal display device further includes a look-up table for determining a corrected value of the field being displayed based on the value of the field being displayed obtained in the data conversion unit and the previous field value obtained in the data conversion unit, wherein the digital gradation data correction unit corrects the value of the field being displayed obtained in the data conversion unit according to the look-up table.

In a fifth aspect of the present invention, a data correction method, in a liquid crystal display device of the field sequential system including a liquid crystal panel that displays an image and configured to display a color by dividing one frame period into a plurality of fields and displaying different colors in the respective fields, includes an RGB data correction step including receiving pixel data that is data represented in an RGB color space and indicating a color of each pixel, and correcting a data value of pixel data such that when a color given by a combination of R, G, and B is incapable of being displayed on the liquid crystal panel by the field sequential system, the data value thereof is corrected to a data value of a color given by a combination of an R, G, and B capable of being displayed on the liquid crystal panel by the field sequential system, a data conversion step including converting the pixel data corrected in the RGB data correction step to digital gradation data capable of being input to the liquid crystal panel for each field, a digital gradation data correction step including correcting the digital gradation data obtained in the data conversion step so as to emphasize a temporal change in a data value, and a liquid crystal panel driving step including driving the liquid crystal panel based on the digital gradation data corrected in the digital gradation data correction step, wherein the RGB data correction step includes converting the pixel data represented in the RGB color space to data represented in an uniform color space, determining a color that is capable of being displayed in the uniform color space by the field sequential system and that has a smallest color difference from the uncorrected color, converting the data representing the determined color to data represented in the RGB color space, and employs a resultant value obtained as a result of the conversion as a corrected data value of the pixel data.

Advantageous Effects of Invention

In the first aspect of the present invention, in the liquid crystal display device of the field sequential system, the data correction is performed as follows. First, pixel data represented in the RGB color space is converted into data represented in the uniform color space. Thereafter, for data of a color being incapable of being displayed by the field sequential system, a data value thereof is corrected such that the corrected value has a smallest color shift in the uniform color space. Thereafter, an inverse conversion is performed from the uniform color space to the RGB color space. Furthermore pixel data obtained via the inverse conversion to the RGB color space is converted to digital gradation data, and this digital gradation data is subjected to a correction for over driving. As described above, for the data of the color incapable of being displayed by the field sequential system, the data value thereof is corrected so as to obtain a smallest color difference between the original uncorrected color and the corrected color in the color space suitable for calculating the color difference. Thus an occurrence of a large color shift is suppressed in displaying a color image. Furthermore, the over driving allows it to expand the displayable range compared to a case where the over driving is not performed. As a result, it is possible to further reduce the color difference between the uncorrected color and the corrected color.

In the second aspect of the present invention, the amount of correction of the data value in performing the over driving (the difference between the uncorrected data value and the corrected data value) is determined depending on the data value in the immediately previous fields, and thus it becomes possible for the transmittance of each pixel to reach the target transmittance more accurately within each field. This suppresses the occurrence of the color shift in a more effective manner.

In the third aspect of the present invention, when the correction for over driving is performed on data in a first field of each frame, it becomes possible to compare the data value in the first field of this frame with the data value in the last field of the immediately previous frame. Therefore, it becomes possible to effectively perform the correction for over driving also on the data in the first field of each frame when a moving image is displayed. As a result, in the liquid crystal display device of the field sequential system, an occurrence of a color shift is suppressed also in displaying moving images.

In the fourth aspect of the present invention, by storing data in advance in the look-up table so as to make it possible to achieve effective over driving, it becomes possible for the transmittance of each pixel to reach the target transmittance more accurately within each field. This suppresses the occurrence of the color shift in a more effective manner.

In the fifth aspect of the present invention, in the data correction method, it is possible to achieve an effect similar to that achieved in the first aspect of the present invention.

DESCRIPTION OF EMBODIMENTS

<0. Introduction>

Figure 2:
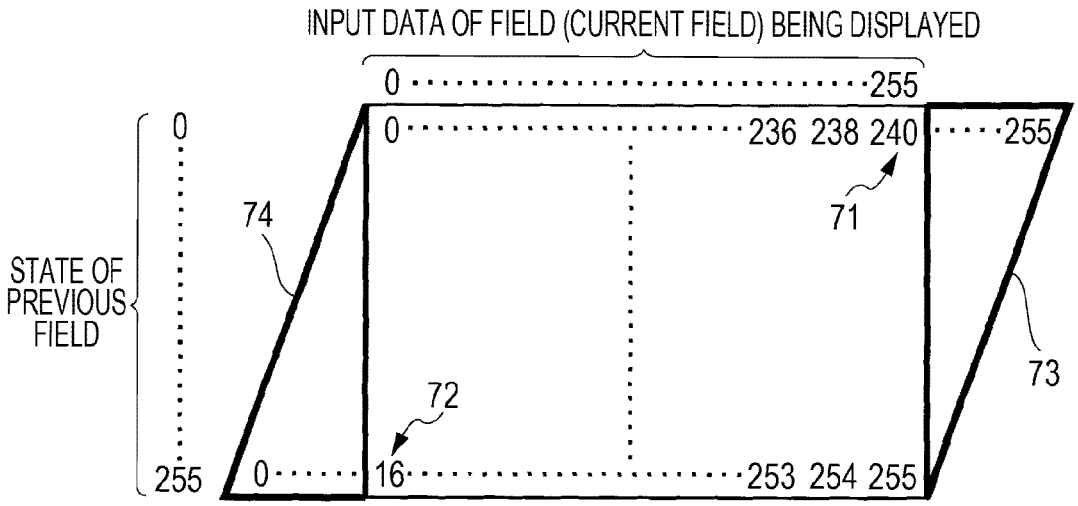
FIG. 2 is a diagram illustrating a relationship among a "state of a liquid crystal in a previous field", a "gradation value of input data in a field being displayed (current field)", and a gradation value corresponding to a reached transmittance".
Figure 3:
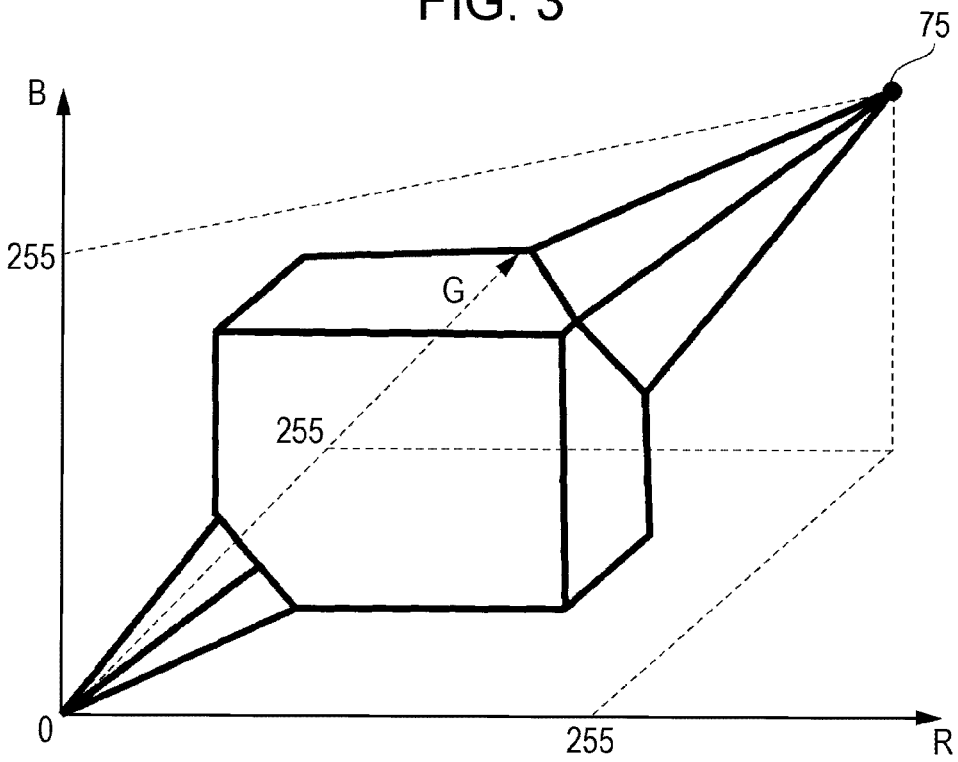
FIG. 3 is a schematic diagram illustrating an RGB displayable range in a liquid crystal display device of the field sequential system.
Figure 4:
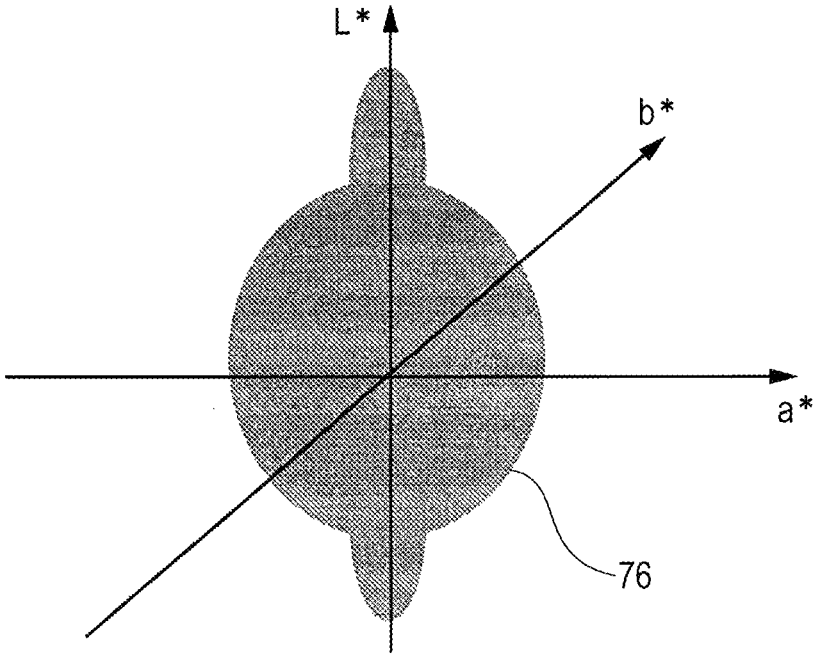
FIG. 4 is a schematic diagram illustrating an L*a*b* displayable range in a liquid crystal display device of the field sequential system.

Before embodiments are described, an outline of the present invention is described below with reference to FIG. 2 to FIG. 4. Note that in a description here and also in a description of each embodiment, it is assumed by way of example that a liquid crystal display device is capable of displaying 256 gradation levels. FIG. 2 is a diagram illustrating a relationship among a "state of a liquid crystal in a previous field", a "gradation value of input data in a field being displayed (current field)", and a "gradation value corresponding to a reached transmittance". Note that the state of the liquid crystal in the previous field is represented in a gradation value. In FIG. 2, for example, in a part pointed to by an arrow denoted by reference numeral 71, it can be seen that when the state of the liquid crystal in the previous field corresponds to a gradation value 0, if a gradation voltage corresponding to a gradation value 255 is applied to the liquid crystal, then a transmittance corresponding to a gradation value 240 is obtained. Furthermore, in FIG. 2, for example, in a part pointed to by an arrow denoted by reference numeral 72, it can be seen that when the state of the liquid crystal in the previous field corresponds to a gradation value 255, if a gradation voltage corresponding to a gradation value 0 is applied to the liquid crystal, then a transmittance corresponding to a gradation value 16 is obtained. Herein if a gradation value related to a state of the liquid crystal in the previous field is defined as a "previous gradation value", and a gradation value of input data in a field being displayed is defined as a "current gradation value", there can be a combination of a previous gradation value and a current gradation value for which a target transmittance cannot be reached within one field. In FIG. 2, a region denoted by reference numeral 73 and a region denoted by reference numeral 74 are color regions that are special in that it is impossible to reach a target transmittance within one field for a combination of a previous gradation value in the region 73 and a current gradation value in the region 74. For example, when the previous gradation value is 0, if the current gradation value is in a range from 241 to 255, then the target transmittance is not reached within one field. Note that the relationship shown in FIG. 2 is merely an example, and the relationship varies depending on the response characteristic of the liquid crystal panel.

Figure 25:
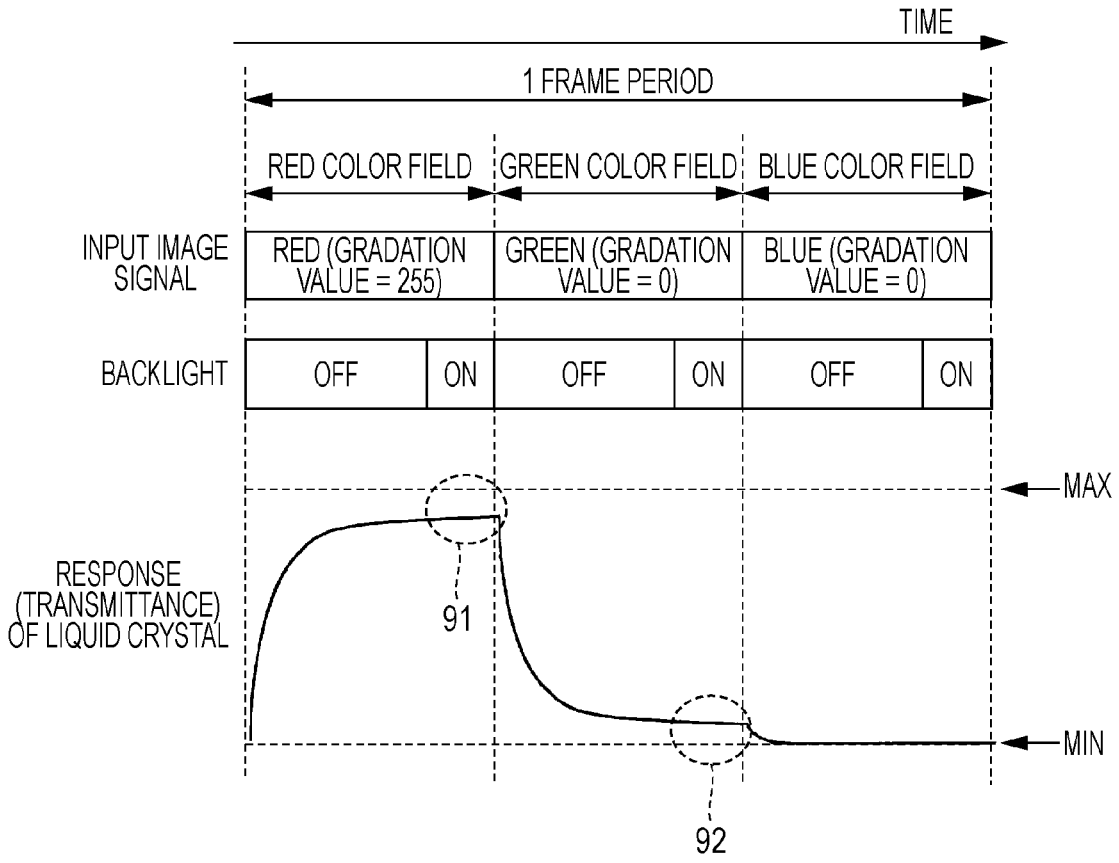
FIG. 25 is a diagram illustrating a phenomenon that occurs when a red color image is displayed on a liquid crystal display device of the field sequential system.
Figure 26:
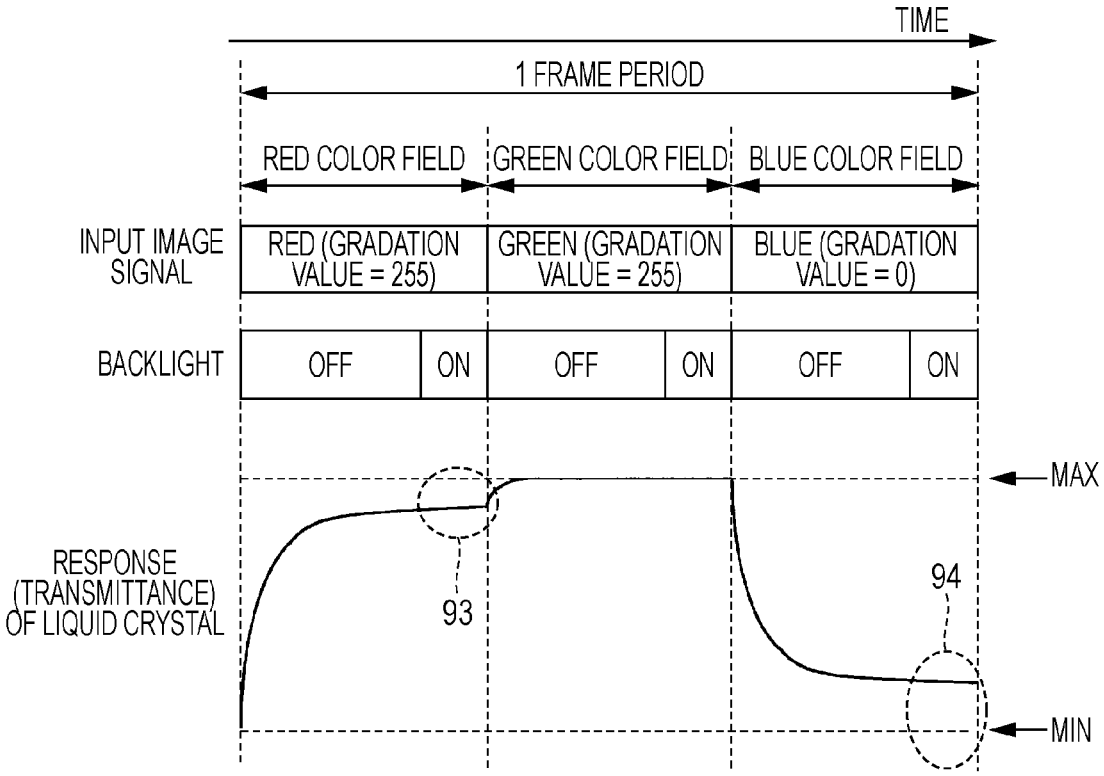
FIG. 26 is a diagram illustrating a phenomenon that occurs when a yellow color image is displayed on a liquid crystal display device of the field sequential system.
Figure 27:
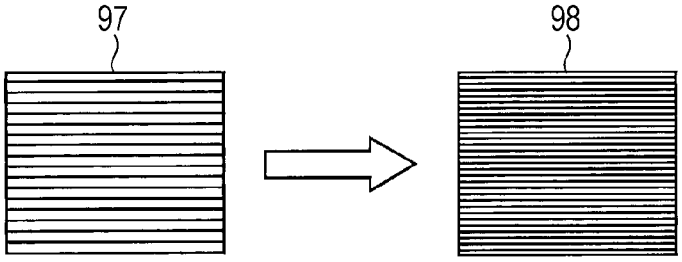
FIG. 27 is a diagram illustrating an example of a color shift.

In the liquid crystal display device of the color filter type, it is allowed to take a gradation value from 0 to 255 for all of R, G, and B. In contrast, in the liquid crystal display device of the field sequential system, there is a "combination of a previous gradation value and a current gradation value" for which a target transmittance cannot be reached within one field as described above, and thus there is an RGB combination that cannot be displayed. Therefore, RGB combinations capable of being displayed by the liquid crystal display device of the field sequential system is limited to RGB combinations in regions schematically represented by bold solid lines in FIG. 3. Note that an RGB combination at a location denoted by reference numeral 75 in FIG. 3 is "R=255, G=255, B=255". Hereinafter, a range (region) given by a set of RGB combinations capable of being displayed is referred to as an "RGB displayable range". In the liquid crystal display device of the field sequential system, when it is tried to display a color defined by an RGB combination of, for example, "R=255, G=0, B=0", a target transmittance is not reached in a red color field and also in a green color field as illustrated in FIG. 25. As a result, a color actually displayed corresponds to an RGB combination of, for example, "R=240, G=14, B=4".

As described above, in the liquid crystal display device of the field sequential system, there is a possibility that a color shift may occur when a color image is displayed. In view of the above, in the present invention, a data value correction is performed on image data to prevent a large color shift from occurring. Note that in the present description, data based on which to generate an image displayed on a display unit of the liquid crystal display device is generically referred to as "image data". That is, an input image signal, tristimulus value data, digital gradation data and the like, which will be described later, are image data.

Various kinds of color spaces are usable to represent colors in a combination of numerical values. In this regard, an RGB color space is suitable to represent colors to be displayed on a display device. However, the RGB color space is not suitable to calculate a color difference perceptible by a human. Therefore, to correct image data so as to achieve a smallest color shift, it is necessary to convert data in the RGB color space to data in a color space suitable for calculating the color difference.

In a CIE1931 XYZ color space which is one of color spaces, a color-matching function is defined so as not to have a negative value. The data value in this XYZ color space is proportional to energy of light stimulus, and thus the XYZ color space is suitable for representing absolute values of colors. However, the XYZ color space is not a color space in which it is possible to evaluate color differences. That is, the XYZ color space is not suitable for calculating color differences. In view of the above, a CIE1976 L*a*b* color space is defined as a uniform color space that allows it to evaluate color differences in a color space. Thus, in each embodiment described below, this L*a*b* color space is used in performing a correction process to suppress an occurrence of a color shift. Note that when the RGB displayable range shown in FIG. 3 is represented in the L*a*b* color space, this region corresponds to a region schematically represented by reference numeral 76 shown in FIG. 4. Hereinafter, the region in the L*a*b* color space corresponding to the RGB displayable range is referred to as a "L*a*b* displayable range".

The procedure of correcting image data according to each embodiment is summarized below. First, data in the RGB color space is converted to data in the L*a*b* color space. If image data is data outside the L*a*b* displayable range, a data value of this image data is corrected so as to obtain a smallest color shift in the L*a*b* color space. The corrected image data is then subjected to an inverse conversion from the L*a*b* color space to the RGB color space. Furthermore, in the RGB color space, a correction for over driving is performed on the image data. In the liquid crystal display device according to the present invention, the image data is corrected in the manner described above.

Embodiments of the present invention are described below with reference to accompanying drawings.

<1. First Embodiment>

<1.1 Overall Configuration and Outline of Operation>

Figure 5:
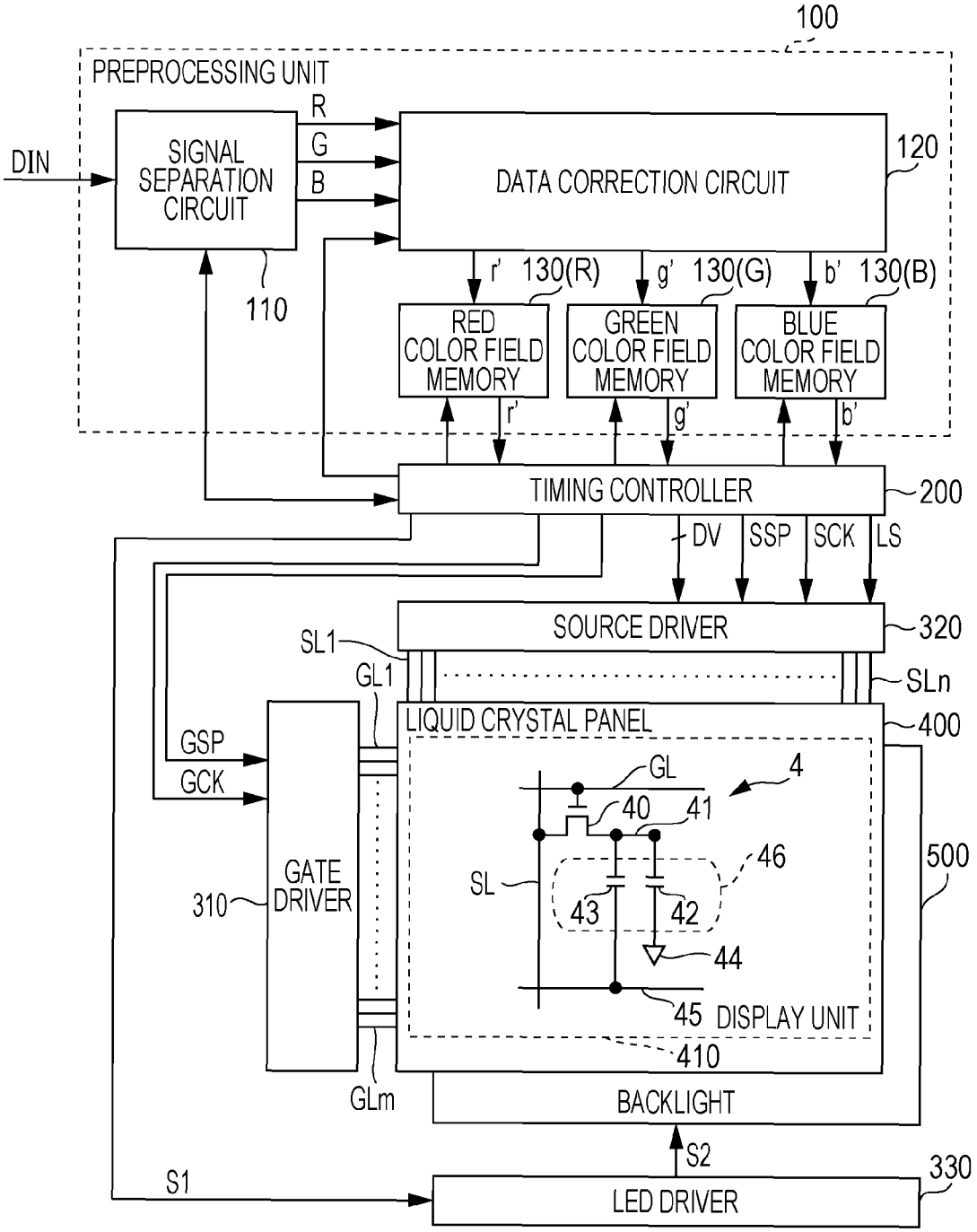
FIG. 5 is a block diagram illustrating an overall configuration of the liquid crystal display device according to the first embodiment.

FIG. 5 is a block diagram illustrating an overall configuration of a liquid crystal display device according to a first embodiment of the present invention. This liquid crystal display device includes a preprocessing unit 100, a timing controller 200, a gate driver 310, a source driver 320, an LED driver 330, a liquid crystal panel 400, and a backlight 500. Note that the gate driver 310 or the source driver 320 or both of them may be disposed within the liquid crystal panel. The liquid crystal panel 400 includes a display unit 410 for displaying an image. The preprocessing unit 100 includes a signal separation circuit 110, a data correction circuit 120, a red color field memory 130(R), a green color field memory 130(G), and a blue color field memory 130(B). In the present embodiment, LEDs (light emitting diodes) are employed as light sources of the backlight 500. More specifically, the backlight 500 includes a red color LED, a green color LED, and a blue color LED. Note that in the present embodiment, a liquid crystal panel driving unit is realized by a combination of the timing controller 200, the gate driver 310, and the source driver 320.

Figure 6:
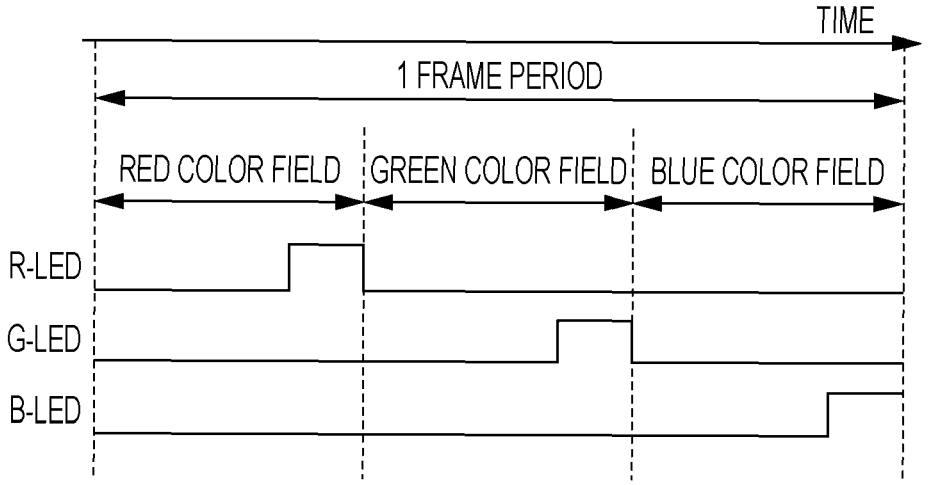
FIG. 6 is a diagram illustrating a structure of one frame period according to the first embodiment.

In the liquid crystal display device according to the present embodiment, the field sequential system is employed. FIG. 6 is a diagram illustrating a structure of one frame period according to the present embodiment. One frame period is divided into a red color field in which a red color screen is displayed based on a red color component of an input image signal DIN, a green color field in which a green color screen is displayed based on a green color component of the input image signal DIN, and a blue color field in which a blue color screen is displayed based on a blue color component of the input image signal DIN. As can be seen from FIG. 6, the red color LED is turned into an on-state in a part of a second half of the red color field, the green color LED is turned into an on-state in a part of a second half of the green color field, and the blue color LED is turned into an on-state in a part of a second half of the blue color field. These red color field, green color field, and blue color field are repeated during the operation of the liquid crystal display device such that a red color screen, a green color screen, and a blue color screen are displayed repeatedly so as to display a desired color image on the display unit 410. Note that there is no specific restriction on the order of the fields. The order of the fields may be, for example, "blue color field, green color field, red color field".

Referring to FIG. 5, on the display unit 410, there are disposed a plurality of (as many as n) source bus lines (image signal lines) SL1 to SLn, and a plurality of (as many as m) gate bus lines (scanning signal lines) GL1 to GLm. A pixel forming part 4 forming a pixel is disposed at a location corresponding to each of intersections between the source bus lines SL1 to SLn and the gate bus lines GL1 to GLm. That is, the display unit 410 includes a plurality of (as many as n×m) pixel forming parts 4. The plurality of pixel forming parts 4 are arranged in the form of a matrix so as to form a pixel matrix having m rows and n columns. Each pixel forming part 4 includes a TFT 40 that is a switching element whose gate terminal is connected to a gate bus line GL passing through a corresponding intersection and whose source terminal is connected to a source bus line SL passing through the above-described intersection, a pixel electrode 41 connected to a drain terminal of the above-described TFT 40, a common electrode 44 and an auxiliary capacitance electrode 45 respectively disposed in common in the plurality of pixel forming parts 4, a liquid crystal capacitance 42 formed by the pixel electrode 41 and the common electrode 44, and an auxiliary capacitance 43 formed by the pixel electrode 41 and an auxiliary capacitance electrode 45. A pixel capacitance 46 is formed by the liquid crystal capacitance 42 and the auxiliary capacitance 43. Note that in FIG. 5, constituent elements of only one pixel forming part 4 in the display unit 410 are shown.

As for the TFT 40 in the display unit 410, for example, an oxide TFT (a thin film transistor using an oxide semiconductor as a channel layer) may be employed. More specifically, a TFT whose channel layer is formed using In—Ga—Zn—O (indium gallium zinc oxide) which is an oxide semiconductor including as main components indium (In), gallium (Ga), zinc (Zn) and oxygen (O) (hereinafter referred to as an "In—Ga—Zn—O-TFT") may be employed as the TFT 40. By employing the In—Ga—Zn—O-TFT configured in the above described manner, it becomes possible to achieve an advantage in terms of a high resolution and low power consumption, and furthermore it also becomes possible to increase the writing speed compared with a conventional writing speed. Alternatively, a transistor whose channel layer is formed using an oxide semiconductor other than In—Ga—Zn—O (indium gallium zinc oxide) may be employed. For example, it is also possible to achieve a similar effect by employing a transistor whose channel layer is formed using an oxide semiconductor including at least one of indium, gallium, zinc, copper (Cu), silicon (Si), tin (Sn), aluminum (Al), calcium (Ca), germanium (Ge), and lead (Pb). Note that the present invention does not exclude use of a TFT other than the oxide TFT.

Next, operations of constituent elements shown in FIG. 5 are described below. The signal separation circuit 110 in the preprocessing unit 100 separates an input image signal DIN given from the outside into data of a red color component, data of a green color component, and data of a blue color component. The signal separation circuit 110 converts the data of the red color component, the data of the green color component, and the data of the blue color component, respectively, to tristimulus value data R, G, and B respectively proportional to the corresponding luminous flux. The signal separation circuit 110 outputs the resultant tristimulus value data R, G, and B.

The data correction circuit 120 in the preprocessing unit 100 corrects the tristimulus value data R, G, and B output from the signal separation circuit 110 so as to achieve a smallest color shift which occurs when an image is displayed. More specifically, the data correction circuit 120 determines an RGB combination that results in a minimum color shift within an RGB displayable range determined based on the response characteristic of the liquid crystal panel, and the data correction circuit 120 converts red data, green data, and blue data of the determined RGB combination to digital gradation data, respectively. Furthermore, the data correction circuit 120 performs a correction for over driving on the digital gradation data. The data correction circuit 120 outputs the resultant data as red color digital gradation data r', green color digital gradation data g', and blue color digital gradation data b'. A further detailed description of the data correction circuit 120 will be given later.

The red color digital gradation data r', the green color digital gradation data g', and the blue color digital gradation data b' output from the data correction circuit 120 are respectively stored in the red color field memory 130(R), the green color field memory 130(G), and the blue color field memory 130(B).

The timing controller 200 reads out the red color digital gradation data r', the green color digital gradation data g', and the blue color digital gradation data b' from the red color field memory 130(R), the green color field memory 130(G), and the blue color field memory 130(B), respectively, and outputs a digital image signal DV, a gate start pulse signal GSP and a gate clock signal GCK both for controlling an operation of the gate driver 310, a source start pulse signal SSP, source clock signal SCK, and a latch strobe signal LS each for controlling an operation of the source driver 320, and an LED driver control signal S1 for controlling an operation of the LED driver 330.

The gate driver 310 applies an active scan signal to each gate bus line GL repeatedly every vertical scanning period based on the gate start pulse signal GSP and the gate clock signal GCK transmitted from the timing controller 200.

The source driver 320 receives the digital image signal DV, the source start pulse signal SSP, the source clock signal SCK, and latch strobe signal LS, transmitted from the timing controller 200, and applies a driving image signal to each source bus line SL. In this process, in the source driver 320, digital image signals DV indicating voltages to be applied to the respective source bus lines SL are sequentially held in synchronization with generation of a pulse of the source clock signal SCK. Thereafter, in synchronization with generation of a pulse of the latch strobe signal LS, the held digital image signals DV are converted to analog voltages. The converted analog voltages are applied as driving image signals, at the same time, to the respective source bus lines SL1 to SLn.

Based on the LED driver control signal S1 transmitted from the timing controller 200, the LED driver 330 outputs a light source control signal S2 to control the state of each LED of the backlight 500. The backlight 500 switches the state of each LED (switching between the on-state and the off-state) properly based on the light source control signal S2.

Thus the scan signals are applied to the gate bus lines GL1 to GLm, the driving image signals are applied to the source bus lines SL1 to SLn, and the state of each LED is properly switched, in the above-described manner such that an image is displayed on the display unit 410 of the liquid crystal panel 400 according to the input image signal DIN.

<1.2 Data Correction Circuit>

Figure 1:
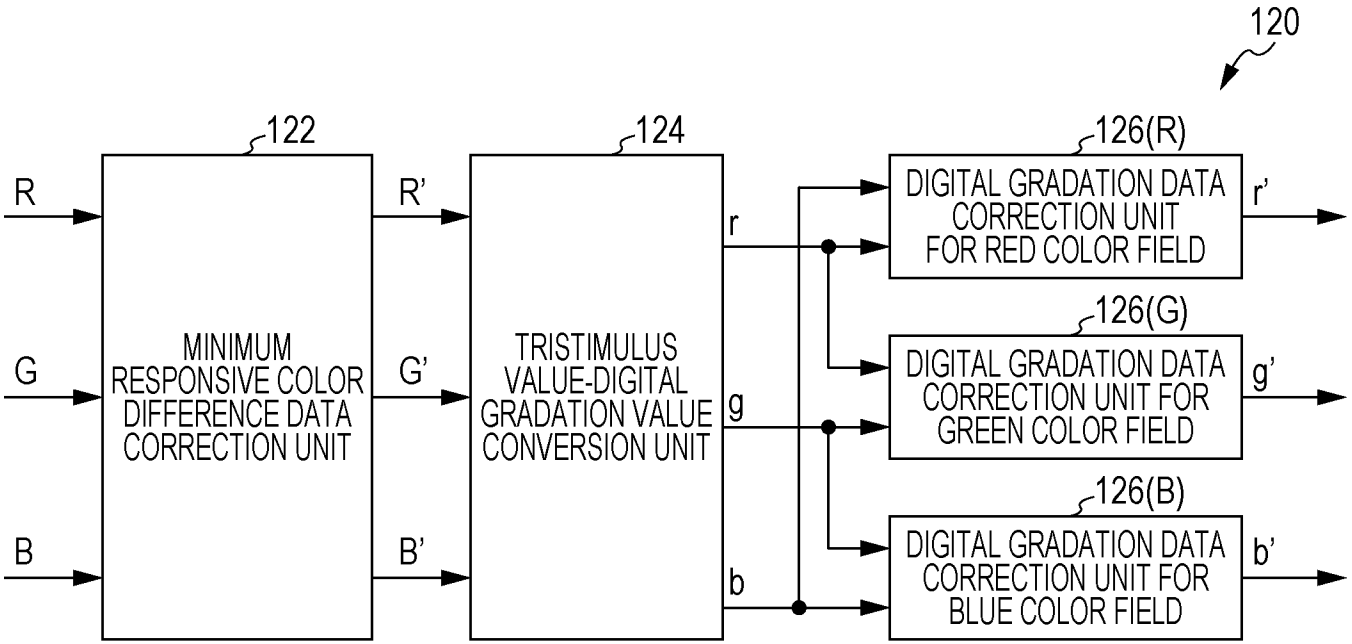
FIG. 1 is a block diagram illustrating a configuration of a data correction circuit of a liquid crystal display device according to a first embodiment of the present invention.

Next, the configuration and the operation of the data correction circuit 120 are described in detail below. FIG. 1 is a block diagram illustrating the configuration of the data correction circuit 120 according to the present embodiment. This data correction circuit 120 includes a minimum responsive color difference data correction unit 122, a tristimulus value-digital gradation value conversion unit 124, a digital gradation data correction unit for red color field 126(R), a digital gradation data correction unit for green color field 126(G), and a digital gradation data correction unit for blue color field 126(B). Hereinafter, the digital gradation data correction unit for red color field 126(R), the digital gradation data correction unit for green color field 126(G), and the digital gradation data correction unit for blue color field 126(B) are also referred to, generically and simply, as a "digital gradation data correction unit".

Note that in the present embodiment, the RGB data correction unit is realized by the minimum responsive color difference data correction unit 122, and the data conversion unit is realized by the tristimulus value-digital gradation value conversion unit 124.

<1.2.1 Minimum Responsive Color Difference Data Correction Unit>

The tristimulus value data R, G, and B output from the signal separation circuit 110 are input to the minimum responsive color difference data correction unit 122. The tristimulus value data R, G, and B are pixel data representing a color of each pixel in the RGB color space. If the color represented by the tristimulus value data R, G, and B is a color outside the displayable range, the minimum responsive color difference data correction unit 122 determines an RGB combination that gives a smallest color shift. Then the minimum responsive color difference data correction unit 122 gives tristimulus value data R', G', and B' corresponding to the determined RGB combination to the tristimulus value-digital gradation value conversion unit 124. As described above, the minimum responsive color difference data correction unit 122 receives tristimulus value data R, G, and B as pixel data, and corrects a data value of a color given by a combination of R, G, and B incapable of being displayed on the liquid crystal panel 400 by the field sequential system to a value of a color given by a combination of R, G, and B capable of being displayed on the liquid crystal panel 400 by the field sequential system. Note that in a case where a color represented by tristimulus value data R, G, and B is within the displayable range, the tristimulus value data R, G, and B are directly given as the tristimulus value data R', G', and B' to the tristimulus value-digital gradation value conversion unit 124.

Figure 7:
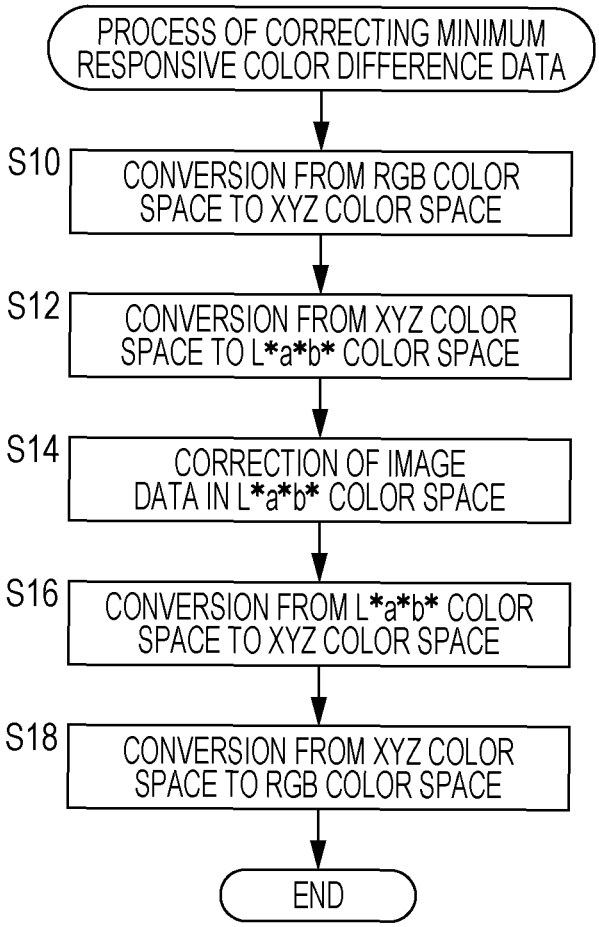
FIG. 7 is a flow chart illustrating a procedure of a minimum responsive color difference data correction process according to the first embodiment.

Now, the correction process (minimum responsive color difference data correction process) performed on the image data by the minimum responsive color difference data correction unit 122 is described in further detail below. FIG. 7 is a flow chart illustrating a procedure of the minimum responsive color difference data correction process. In the minimum responsive color difference data correction process, first, the image data under the process is subjected to the conversion from the RGB color space to the XYZ color space (step S10). The conversion from the RGB color space to the XYZ color space is performed according to equation (1) shown below.

[Math. 1]

$$\begin{pmatrix} X \\ Y \\ Z \end{pmatrix} = \begin{pmatrix} 2.7690 & 1.7517 & 1.1301 \\ 1.0000 & 4.5907 & 0.0601 \\ 0.0000 & 0.0565 & 5.5928 \end{pmatrix} \begin{pmatrix} R \\ G \\ B \end{pmatrix} \quad (1)$$

Next, the image data under the process is subjected to the conversion from the XYZ color space to the L*a*b* color space (step S12). The conversion from the XYZ color space to the L*a*b* color space is performed according to equations (2) to (4) shown below. Note that in the equations (2) to (4), Xn, Yn, and Zn respectively denote values of X, Y, and Z of a reference white point.

$$L^*=116f(Y/Yn)-16 \quad (2)$$

$$a^*=500[f(X/Xn)-f(Y/Yn)] \quad (3)$$

$$b^*=200[f(Y/Yn)-f(Z/Zn)] \quad (4)$$

where function f(t) is defined as follow. When t is greater than $(6/29)^3$, f(t) is represented by equation (5) shown below.

[Math. 2]

$$f(t)=t^{1/3} \quad (5)$$

When t is equal to or smaller than $(6/29)^3$, f(t) is represented by equation (6) shown below.

[Math. 3]

$$f(t)=(1/3)\times(29/6)^2\times t+(4/29) \quad (6)$$

After the conversion from the RGB color space to the L*a*b color space on the image data under the process is completed, data values of the image data is corrected in the L*a*b* color space (step S14). To realize the correction in this step S14, data representing the displayable range by the field sequential system (hereinafter, referred to as the "displayable range data") is stored, in advance, in the L*a*b* format in the minimum responsive color difference data correction unit 122. That is, data representing the L*a*b* displayable range is stored in advance in the minimum responsive color difference data correction unit 122.

Figure 8:
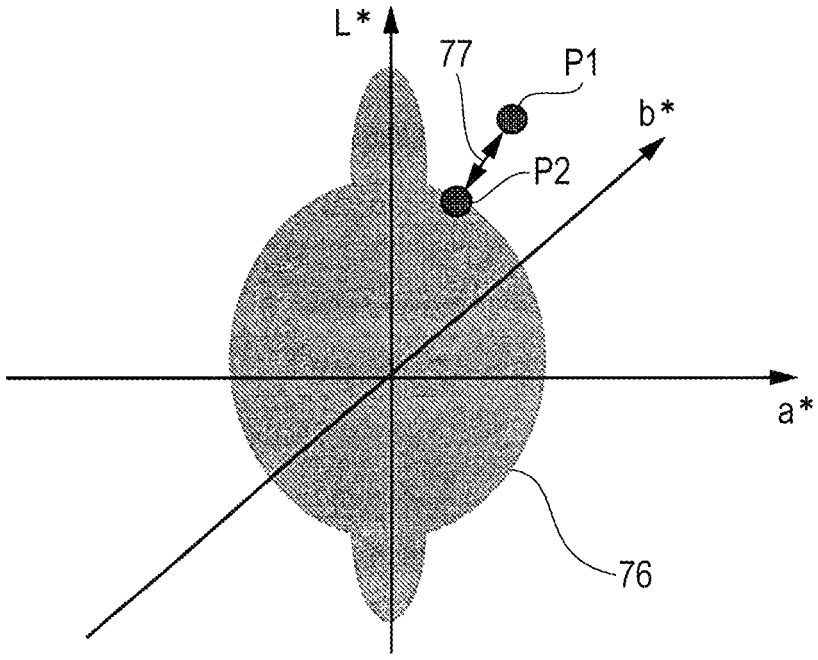
FIG. 8 is a diagram for illustrating a correction on image data in an L*a*b* color space according to the first embodiment.

Here, the correction process (the process in step 14) on the image data in the L*a*b* color space is described in detail below with reference to FIG. 8. Note that it is assumed in FIG. 8 that an L*a*b* value of image data is given by a value at a location denoted by reference numeral P1 before the correction, and this L*a*b* value of the image data is corrected to a value at a location denoted by reference numeral P2. A color difference ΔE*ab between two points in the L*a*b* color space is represented by equation (7) shown below.

[Math. 4]

$$\Delta E^*ab=\{(\Delta L^*)^2+(\Delta a^*)^2+(\Delta b^*)^2\}^{1/2} \quad (7)$$

where ΔL* denotes the difference of the L* value between the two points, Δa* denotes the difference of the a* value between the two points, and Δb* denotes the difference of the b* value between the two points.

When the L* value, the a* value, and the b* value of the image data before the correction are respectively denoted by L, a, and b, and the L* value, the a* value, and the b* value of the image data after the correction are respectively denoted by L', a', and b', then ΔL*, Δa*, and Δb* in equation (7) shown above are represented respectively by equations (8), (9), and (10) shown below.

$$\Delta L^*=L-L' \quad (8)$$

$$\Delta a^*=a-a' \quad (9)$$

$$\Delta b^*=b-b' \quad (10)$$

In the present embodiment, a combination of L', a', and b' that given a minimum color difference ΔE*ab is determined under the condition that the color represented by L', a' and b' falls within the L*a*b* displayable range, and the resultant combination of L', a', and b' is employed as a corrected L*a*b value of the image data. Note that in a case where a color represented by L, a, and b is within the L*a*b* displayable range, no correction is performed on the data value of the image data.

After step 14 is completed, a conversion from the L*a*b* color space to the XYZ color space is performed on the image data (step S16). The conversion performed in this step S16 is a conversion inverted to the conversion (step S12) from the XYZ color space to the L*a*b* color space. Thereafter, a conversion from the XYZ color space to the RGB color space is performed on the image data (step S18). The conversion performed in this step S18 is a conversion inverted to the conversion (step S10) from the RGB color space to the XYZ color space. The data obtained in step S18 is given as tristimulus value data R', G', and B' to the tristimulus value-digital gradation value conversion unit 124 from the minimum responsive color difference data correction unit 122.

Via the process described above, the minimum responsive color difference data correction unit 122 converts the pixel data (tristimulus value data R, G, and B) represented in the RGB color space to data represented in the L*a*b* color space which is an uniform color space, and determines a color that is capable of being displayed in the L*a*b* color space by the field sequential system and that has a minimum color difference from the original uncorrected color. The minimum responsive color difference data correction unit 122 then converts the data representing the determined color to data represented in the RGB color space and employs the resultant values as data values of the corrected pixel data (tristimulus value data R', G', and B').

Thus the data value correction is performed on the image date outside the RGB displayable range in the manner as described above so as to obtain a smallest color difference between the original uncorrected color and the corrected color. Note that although in the present embodiment, the L*a*b* color space is used to determine the color difference of the uncorrected color and the corrected color, the present invention is not limited to this. Another color space other than the L*a*b* color space, for example, a CIE1976 L*u*v* color space or the like may be used as long as the color space is a color space (uniform color space) suitable for calculating the color difference. For example, a color space (uniform color space) suitable for calculating the color difference may be originally defined.

<1.2.2 Tristimulus Value-Digital Gradation Value Conversion Unit>

The tristimulus value-digital gradation value conversion unit 124 convers the tristimulus value data R', G', and B' given from the minimum responsive color difference data correction unit 122 to digital gradation data that is data capable of being input to the liquid crystal panel 400 and that corresponds to one of fields (the red color field, the green color field, and the blue color field) forming one frame period. That is, in the tristimulus value-digital gradation value conversion unit 124, the tristimulus value data R' is converted to red color digital gradation data r, the tristimulus value data G' is converted to green color digital gradation data g, and the tristimulus value data B' is converted to blue color digital gradation data b.

<1.2.3 Digital Gradation Data Correction Unit>

The digital gradation data correction unit for red color field 126(R) receives the red color digital gradation data r and the blue color digital gradation data b, and performs correction for over driving on the red color digital gradation data r depending on a value (gradation value) of the blue color digital gradation data b. The digital gradation data correction unit for green color field 126(G) receives the green color digital gradation data g and the red color digital gradation data r, and performs correction for over driving on the green color digital gradation data g depending on a value (gradation value) of the red color digital gradation data r. The digital gradation data correction unit for blue color field 126(B) receives the blue color digital gradation data b and the green color digital gradation data g, and performs correction for over driving on the blue color digital gradation data b depending on a value (gradation value) of the green color digital gradation data g. Now, for arbitrary one of colors, the process of the correction for over driving is described in detail below.

Figures 9, 10:
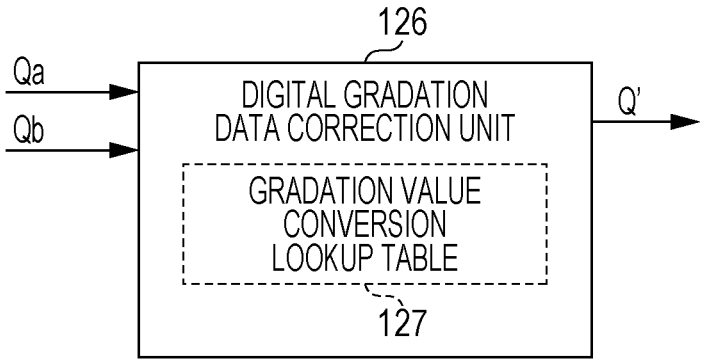
FIG. 9 is a diagram illustrating a digital gradation data correction unit according to the first embodiment.
FIG. 10 is a diagram illustrating an example of a gradation value conversion look-up table according to the present embodiment.

FIG. 9 is a diagram for illustrating the digital gradation data correction unit 126. The digital gradation data correction unit 126 has a gradation value conversion look-up table 127 described later. Digital gradation data Qa of the previous field and digital gradation data Qb of the field being displayed (the current field) are input to the digital gradation data correction unit 126. Note that hereinafter, a value (a gradation value) of the digital gradation data Qa of the previous field is referred to as a "previous field value", and a value (a gradation value) of the digital gradation data Qb of the field being displayed is referred to as a "value of the field being displayed". Based on the gradation value conversion look-up table 127, the digital gradation data correction unit 126 determines an output value corresponding to a combination of the previous field value and the value of the field being displayed. The output value determined based on the gradation value conversion look-up table 127 is output as digital gradation data Q' from the digital gradation data correction unit 126.

FIG. 10 is a diagram illustrating an example of the gradation value conversion look-up table 127. In FIG. 10, numerical values described in the leftmost column indicate previous field values, and numerical values described in the top row indicate values of the field being displayed. A numerical value described at each location where one of rows and one of columns intersects indicates a gradation value (an output value) corresponding to a driving voltage determined based on a combinations of a previous field value and a value of the field being displayed. For example, in a case where the previous field value is "128" and the value of the field being displayed is "192", the output value is "219". As another example, in a case where the previous field value is "128" and the value of the field being displayed is "32", the output value is "21". As described above, the output values in the gradation value conversion look-up table 127 are determined so as to emphasize temporal changes of data values of the digital gradation data. Note that the values described in the gradation value conversion look-up table 127 are dependent on the response characteristic, measured in advance, of the employed liquid crystal panel.

Note that in the gradation value conversion look-up table 127 according to the present embodiment, only nine gradation values of a total of 256 gradation values are described as previous field values and also value of the field being displayed. That is, only values corresponding to part of combinations of gradation values of all gradation values capable of being displayed by the liquid crystal panel 400 are described as output values in the gradation value conversion look-up table 127. Therefore, for example, in a case where the previous field value is "48", and the value of the field being displayed is "140", it is impossible to determine an output value directly from the gradation value conversion look-up table 127. In such a case, the output value for the previous field value of "48" and the value of the field being displayed of "140" is determined by an interpolating calculation based on an output value given in a case in which the previous field value is "32" and the value of the field being displayed is "128", an output value given in a case in which the previous field value is "32" and the value of the field being displayed is "160", an output value given in a case in which the previous field value is "64" and the value of the field being displayed is "128", and an output value given in a case in which the previous field value is "64" and the value of the field being displayed is "160". This interpolating calculation is described in further detail below.

In the present embodiment, the interpolating calculation is performed using a linear approximation. Hereinafter, regarding the data whose output value is to be determined, the value of the field being displayed is denoted by "cur_i", and the previous field value is denoted by "pre_i". Furthermore, two value of the field being displayed used in the interpolating calculation are denoted by "cur_l" and "cur_r, and two previous field values used in the interpolating calculation are denoted by "pre_u" and "pre_d". Under the notation described above, the value of cur_l and the value of cur_r are determined depending on the value of cur_i as follows. When cur_i is equal to or greater than 0 and smaller than 32, cur_l=0 and cur_r=32. When cur_i is equal to or greater than 32 and smaller than 64, cur_l=32 and cur_r=64. When cur_i is equal to or greater than 64 and smaller than 96, cur_l=64 and cur_r=96. When cur_i is equal to or greater than 96 and smaller than 128, cur_l=96 and cur_r=128. When cur_i is equal to or greater than 128 and smaller than 160, cur_l=128 and cur_r=160. When cur_i is equal to or greater than 160 and smaller than 192, cur_l=160 and cur_r=192. When cur_i is equal to or greater than 192 and smaller than 224, cur_l=192 and cur_r=224. When cur_i is equal to or greater than 224 and equal to or smaller than 255, cur_l=224 and cur_r=255. The value of pre_u and the value of pre_d are determined depending on the value of pre_i as follows. When pre_i is equal to or greater than 0 and smaller than 32, pre_u=0 and pre_d=32. When pre_i is equal to or greater than 32 and smaller than 64, pre_u=32 and pre_d=64. When pre_i is equal to or greater than 64 and smaller than 96, pre_u=64 and pre_d=96. When pre_i is equal to or greater than 96 and smaller than 128, pre_u=96 and pre_d=128. When pre_i is equal to or greater than 128 and smaller than 160, pre_u=128 and pre_d=160. When pre_i is equal to or greater than 160 and smaller than 192, pre_u=160 and pre_d=192. When pre_i is equal to or greater than 192 and smaller than 224, pre_u=192 and pre_d=224. When pre_i is equal to or greater than 224 and equal to or smaller than 255, pre_u=224 and pre_d=255.

In the present embodiment, to determine the output value k, first, a correction value Δp for the value of the field being displayed and a correction value Δv for the previous field value are determined. Note that in equations (11) to (14) described below, an output value corresponding to a combination of pre_u and a cur_l is denoted by "ul", an output value corresponding to a combination of pre_u and a cur_r is denoted by "ur", an output value corresponding to a combination of pre_d and a cur_l is denoted by "dl", and an output value corresponding to a combination of pre_d and a cur_r is denoted by "dr".

When cur_i is greater than pre_i, the correction value Δp for the value of the field being displayed is determined according to equation (11) shown below and the correction value Δv for the previous field value is determined according to equation (12) shown below.

[Math. 5]

$$\Delta p = \frac{ul - ur}{\text{cur_l} - \text{cur_r}} \times (\text{cur_i} - \text{cur_r}) \tag{11}$$

[Math. 6]

$$\Delta v = \frac{dr - ur}{\text{pre_d} - \text{pre_u}} \times (\text{pre_i} - \text{pre_u}) \tag{12}$$

When cur_i is smaller than pre_i, the correction value Δp for the value of the field being displayed is determined according to equation (13) shown below the correction value Δv for the previous field value is determined according to equation (14) shown below.

[Math. 7]

$$\Delta p = \frac{dr - dl}{\text{cur_r} - \text{cur_l}} \times (\text{cur_i} - \text{cur_l}) \tag{13}$$

[Math. 8]

$$\Delta v = \frac{ul - dl}{\text{pre_u} - \text{pre_d}} \times (\text{pre_i} - \text{pre_d}) \tag{14}$$

By using the correction value Δp for the value of the field being displayed and the correction value Δv for the previous field value determined in the above-described manner, the output value k of the data under the process is determined as follows. When cur_i is greater than pre_i, the output value k is determined according to equation (15) shown below.

$$k = ur + \Delta p + \Delta v \tag{15}$$

When cur_i is smaller than pre_i, the output value k is determined according to equation (16) shown below.

$$k = dl + \Delta p + \Delta v \tag{16}$$

Next, a specific example of a calculation is described below for a case where "cur_i=140" and "pre_i=48". In the case of this example, values are obtained from the gradation value conversion look-up table 127 shown in FIG. 10 as follows: cur_l=128; cur_r=160; pre_u=32; pre_d=64; ul=172; ur=203; dl=149; and dr=192. In this case, cur_i is greater than pre_i, and thus the correction value Δp for the value of the field being displayed is determined according to equation (11) shown above, the correction value Δv for the previous field value is determined according to equation (12) shown above. That is, Δp and Δv are determined as follow.

$$\Delta p = ((172-203)/(128-160)) \times (140-160) = -19.375$$

$$\Delta v = ((192-203)/(64-32)) \times (48-32) = -5.5$$

Using Δp and Δv obtained in the above-described manner, the output value k is determined according to equation (15) shown above. That is, the output value k is determined as follows.

$$k = 203 - 19.375 - 5.5 = 178.125$$

The digital gradation data has a digital value, and thus the output value k is obtained as 178.

The digital gradation data correction unit 126 performs the correction for over driving on the digital gradation data of each color in the above-described manner. Note that in the present embodiment, only part of all gradation values capable of being displayed by the liquid crystal panel 400 are described as previous field values and also value of the field being displayed in the gradation value conversion look-up table 127. However, the present invention is not limited this. When it is allowed to increase the memory capacity, all gradation values capable of being represented by the liquid crystal panel 400 may be stored as previous field values and value of the field being displayed in the gradation value conversion look-up table 127. In this case, no error due to the interpolating calculation occurs, and thus it becomes possible to more effectively prevent an occurrence of a color shift, although it is necessary to increase the capacity of the memory installed on the liquid crystal display device.

<1.3 Advantageous Effects>

In the present embodiment, in the liquid crystal display device of the field sequential system, the correction is performed on the image data as follows. First, the image data is converted from RGB color space to the XYZ color space, and further from the XYZ color space to the L* a*b* color space. Thereafter, for image data of a color that cannot be displayed on the liquid crystal panel 400 by the field sequential system, a data value is corrected so as to obtain a smallest color shift in the L* a*b* color space. Thereafter, the inverse conversion from the L*a*b* color space to the XYZ color space is performed and further the inverse conversion from the XYZ color space to the RGB color space is performed. Furthermore, the correction for over driving is performed on the image data obtained via the inverse conversion to the RGB color space. As described above, for image data outside the RGB displayable range, a data value of a color is corrected such that the smallest color difference is obtained between the original uncorrected color and the corrected color in the color space suitable for calculating the color difference. This makes it possible to suppress an occurrence of a large color shift when a color image is displayed. Furthermore, use of over driving allows an expansion of the RGB displayable range compared to a case where the over driving is not performed. This makes it possible to further reduce the color difference between the original uncorrected color and the corrected color.

Figure 11:
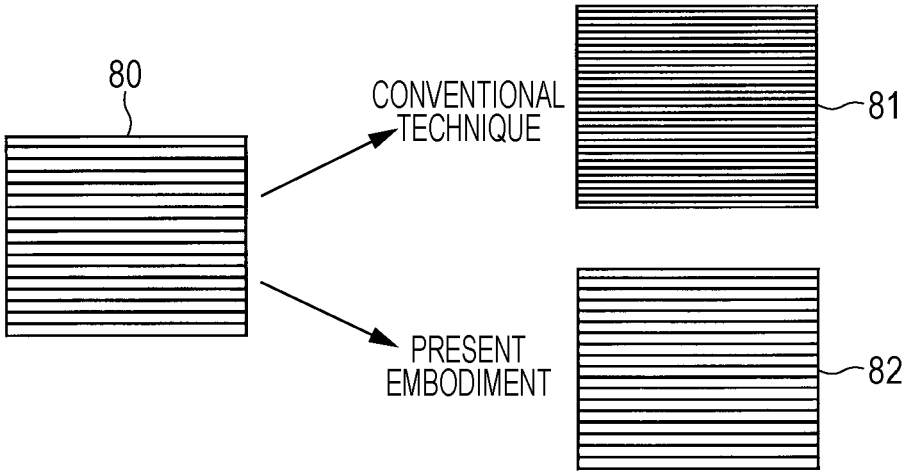
FIG. 11 is a diagram illustrating an effect provided by the first embodiment.

The process described above may be illustrated schematically as follows. For example, when a color is to be displayed in a manner as denoted by reference numeral 80 in FIG. 11, a color is displayed by the conventional technique, for example, in a manner as denoted by reference numeral 81 in FIG. 11. However, in the present embodiment, a color is displayed in a manner as denoted by reference numeral 82 in FIG. 11. As described above, the present embodiment makes it possible to greatly suppress an occurrence of a color shift compared to the conventional technique. That is, it is possible to realize a liquid crystal display device of the field sequential system capable of suppressing an occurrence of a color shift.

<2. Second Embodiment>

<2.1 Outline>

Figure 12:
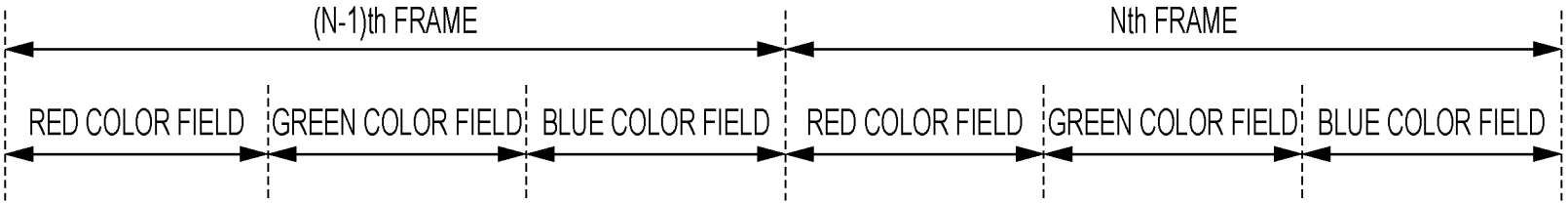
FIG. 12 is a diagram for illustrating an outline of a second embodiment of the present invention.

In the first embodiment described above, the digital gradation data correction unit 126 performs the correction for over driving based on gradation values of two fields included in the same frame. Therefore, for a gradation value of a red color field which is a first field of a frame, the correction for over driving is performed depending on a gradation value of a blue color field in a current frame. This scheme does not lead to a problem in a case where a still image is displayed. However, in a case where a moving image is displayed, the gradation value of each field changes from one frame to another, and thus the above-described scheme may not allow the over driving to provide a desired effect, because, as may be seen from FIG. 12, to perform the correction for over driving on a gradation value of a red color field in a certain frame (an N-th frame in the example in FIG. 12), it is necessary to compare the gradation value of the red color field in this frame with a gradation value of a blue color field in an immediately previous frame (an (N−1)th frame in the example in FIG. 12). In view of the above, in the present embodiment, the data correction circuit 120 is configured such that it is possible to compare a gradation value of a first field in each frame with a gradation value of a last field of an immediately previous frame.

<2.2 Configuration>

Figure 13:
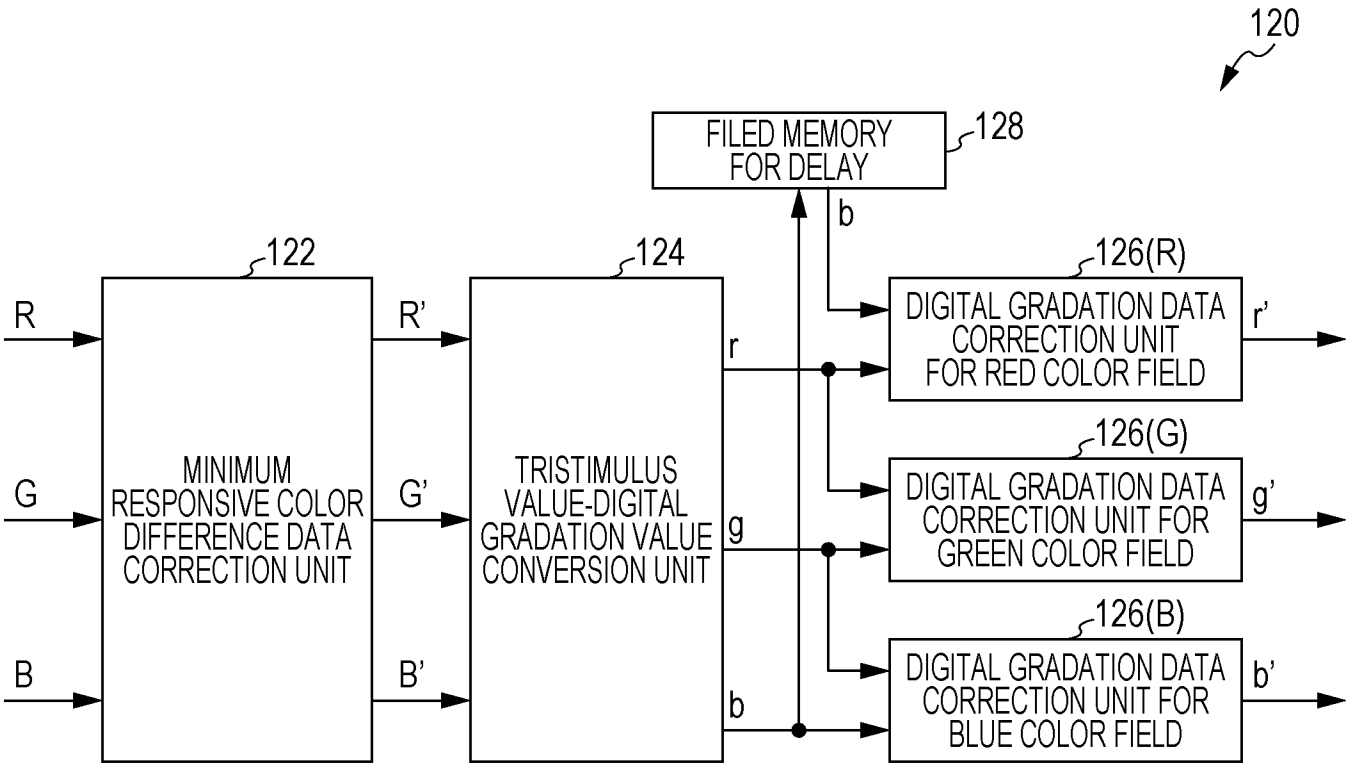
FIG. 13 is a block diagram illustrating a configuration of a data correction circuit according to the second embodiment.

The overall configuration and the outline of operation are similar to those according to the first embodiment described above, and thus a description thereof is omitted. FIG. 13 is a block diagram illustrating the configuration of the data correction circuit 120 according to the present embodiment. The data correction circuit 120 according to the present embodiment includes a delay field memory 128 in addition to the constituent elements according to the first embodiment described above. In this delay field memory 128, the blue color digital gradation data b output from the tristimulus value-digital gradation value conversion unit 124 is stored. The blue color digital gradation data b stored in the delay field memory 128 is held for one frame period. The provision of such a delay field memory 128 in the data correction circuit 120 makes it possible for the digital gradation data correction unit for red color field 126(R) to compare the gradation value of the red color field in each frame with the gradation value of the blue color field in the immediately previous frame. That is, the digital gradation data correction unit for red color field 126(R) according to the present embodiment performs the correction for over driving on the red color digital gradation data r output from the tristimulus value-digital gradation value conversion unit 124 depending on the gradation value of the blue color field in the immediately previous frame.

<2.3 Advantageous Effects>

In the present embodiment, when the correction for over driving is performed on data of a first field of each frame, it is possible to compare the gradation value of the first field in this frame with the gradation value of the last field in the immediately previous frame. Therefore, it becomes possible to effectively perform the correction for over driving on the data in the first field of each frame also when a moving image is displayed. As a result, in the liquid crystal display device of the field sequential system, an occurrence of a color shift is suppressed also in displaying moving images.

<3. Third Embodiment>

<3.1 Configuration and the Like>

Figure 14:
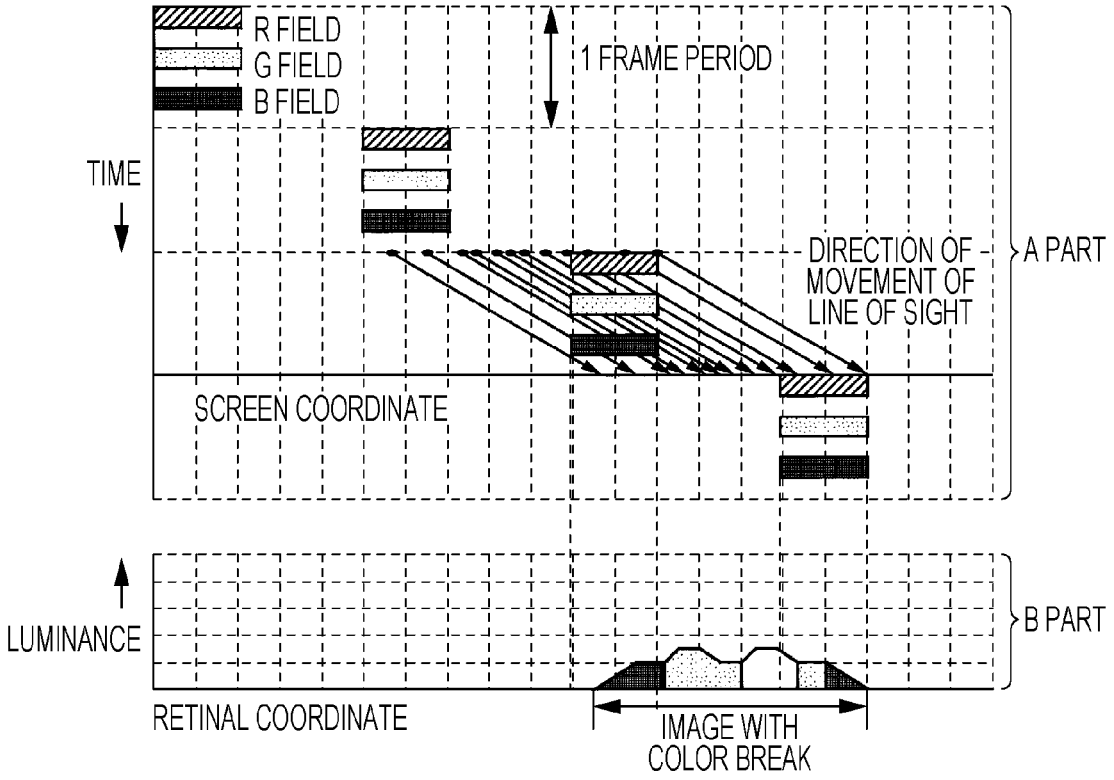
FIG. 14 is a diagram illustrating a mechanism of an occurrence of color breakup.

It is known that the liquid crystal display device of the field sequential system has a problem that a color break occurs. FIG. 14 is a diagram illustrating a mechanism of an occurrence of color breakup. In part A of FIG. 14, a vertical axis represents time, and a horizontal axis represents a location on a screen. In general, when an object moves in the display screen, a line of sight of a viewer moves in a direction in which the object moves while following the movement of the object. In the example shown in FIG. 14, when a white object moves in the display screen from the left to the right, the line of sight of the viewer moves in a direction denoted by a diagonal arrow. On the other hand, in a case where three field images of R, G, and B are extracted from an image of the same instant, the locations the object are the same in these field images. As a result, as illustrated in part B of FIG. 14, a color break occurs in an image formed on a retina. To handle such a color break, it has been proposed to provide a field in one frame period such that a color different from any of the three primary colors, that is, at least two colors (a mixed color) are displayed in this field. More specifically, by providing a white color field in one frame period such that a white screen is displayed in this white color field, it is possible to effectively suppress an occurrence of a color break. In view of the above, in the present embodiment, a white color field is provided in one frame period.

Figure 15:
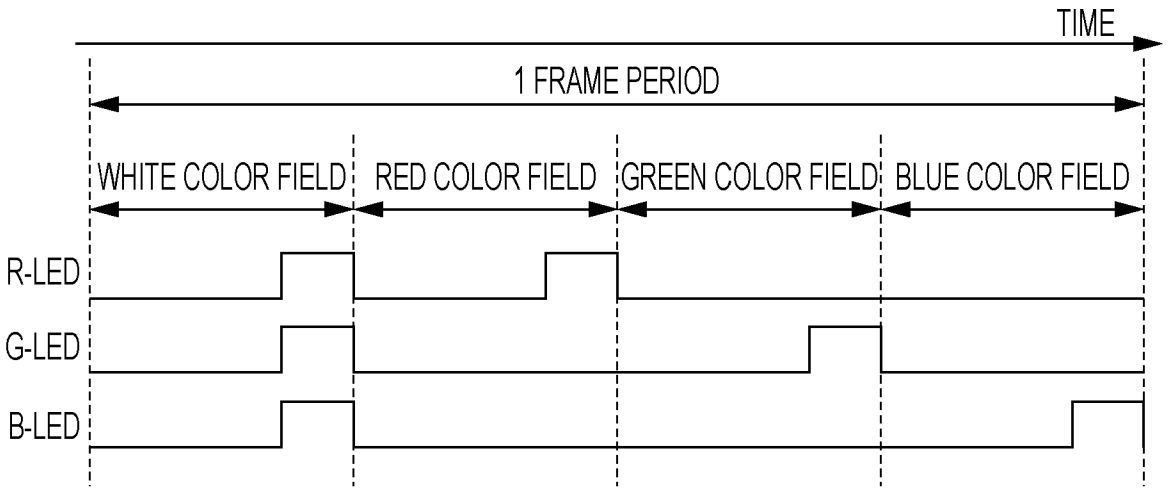
FIG. 15 is a diagram illustrating a structure of one frame period according to the third embodiment.

FIG. 15 is a diagram illustrating a structure of one frame period according to the present embodiment. As illustrated in FIG. 15, in the present embodiment, one frame period is divided into a white color field, a red color field, a green color field, and a blue color field. In the white color field, a red color LED, a green color LED, and a blue color LED are in the on-state for a part of a second half of its period. In the red color field, the red color LED is in the on-state for a part of a second half of its period. In the green color field, the green color LED is in the on-state for a part of a second half of its period. In the blue color field, the blue color LED is in the on-state for a part of a second half of its period. During the operation of the liquid crystal display device, the white color field, the red color field, the green color field, and the blue color field are repeated. As a result, a white color screen, a red color screen, a green color screen, and a blue color screen are displayed repeatedly so as to display a desired color image on the display unit 410. Note that there is no specific restriction on the order of the fields. The order of the fields may be, for example, "white color field, blue color field, green color field, red color field". In the present embodiment, as described above, each frame includes a white color field in addition to a red color field, a green color field, and a blue color field.

Hereinafter, a combination of a data value of a white color component, a data value of a red color component, a data value of a green color component, and a data value of a blue color component is referred to as a "WRGB combination". Furthermore, a range (a region) represented by a set of WRGB combinations capable of being displayed is referred to as a "WRGB displayable range".

Figure 16:
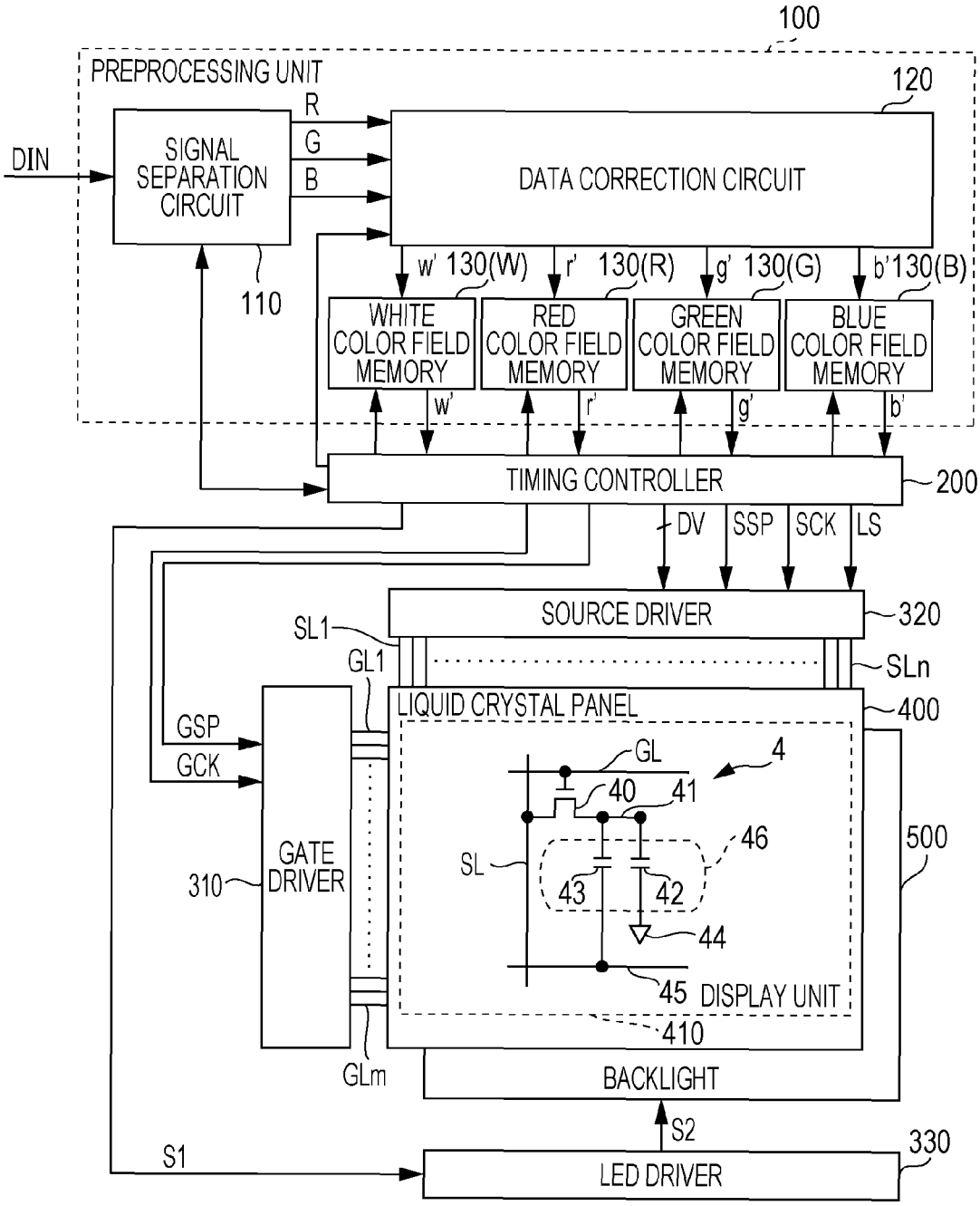
FIG. 16 is a block diagram illustrating an overall configuration of the liquid crystal display device according to the third embodiment.

FIG. 16 is a block diagram illustrating an overall configuration of the liquid crystal display device according to the present embodiment. Note that the following description focuses on differences from the first embodiment, and a description of what is similar to the first embodiment is omitted. In the present embodiment, the preprocessing unit 100 includes a white color field memory 130(W) in addition to constituent elements (see FIG. 5) according to the first embodiment. The data correction circuit 120 outputs white color digital gradation data w' in addition to red color digital gradation data r', green color digital gradation data g', and blue color digital gradation data b'. The white color digital gradation data w' is stored in the white color field memory 130(W). The timing controller 200 reads out the white color digital gradation data w', the red color digital gradation data r', the green color digital gradation data g', and the blue color digital gradation data b', respectively, from the white color field memory 130(W), the red color field memory 130(R), the green color field memory 130(G), and the blue color field memory 130(B), and outputs a digital image signal DV or the like.

<3.2 Data Correction Circuit>

Figure 17:
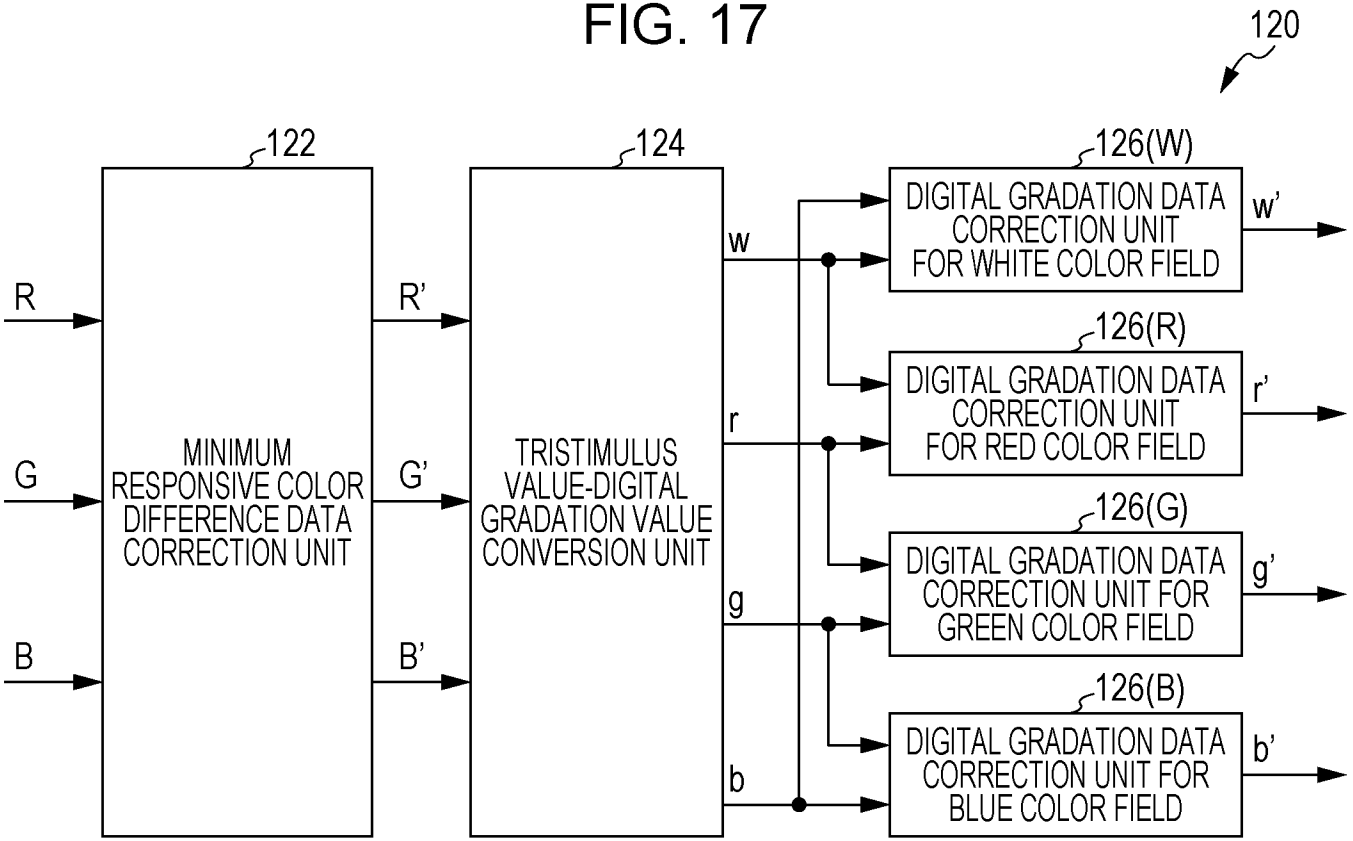
FIG. 17 is a block diagram illustrating a configuration of a data correction circuit according to the third embodiment.

FIG. 17 is a block diagram illustrating a configuration of the data correction circuit 120 according to the present embodiment. In the present embodiment, the data correction circuit 120 includes a digital gradation data correction unit for white color field 126(W) in addition to the constituent elements (see FIG. 1) according to the first embodiment.

<3.2.1 Minimum Responsive Color Difference Data Correction Unit>

The minimum responsive color difference data correction unit 122 operates in a similar manner to that according to the first embodiment. That is, if a color represented by the tristimulus value data R, G, and B given from the signal separation circuit 110 is a color outside the displayable range, the minimum responsive color difference data correction unit 122 determines an RGB combination that results in a minimum color shift. Then the minimum responsive color difference data correction unit 122 gives tristimulus value data R', G', and B' corresponding to the determined RGB combination to the tristimulus value-digital gradation value conversion unit 124. Note that, as in the first embodiment, in a case where a color represented by tristimulus value data R, G, and B is within the displayable range, the tristimulus value data R, G, and B are directly given as the tristimulus value data R', G', and B' to the tristimulus value-digital gradation value conversion unit 124.

In the present embodiment, unlike the first embodiment in which one frame period is divided into three fields, one frame period is divided into four fields. Therefore, in the present embodiment, the length of one field is shorter than the length of one field according to the first embodiment. In the first embodiment described above, there are three transitions (a transition from a red color field to a green color field, a transition from a green color field to a blue color field, and a transition from a blue color field to a red color field). In the present embodiment, there are four transitions (a transition from a white color field to a red color field, a transition from a red color field to a green color field, a transition from a green color field to a blue color field, and a transition from a blue color field to a white color field). Thus, the displayable range according to the embodiment is different from the displayable range according to the first embodiment. Therefore, in the present embodiment, the content of the displayable range data stored in the minimum responsive color difference data correction unit 122 in the data correction circuit 120 is different from that according to the first embodiment.

Note that the displayable range data according to the present embodiment is determined as follows. First, the WRGB displayable range is determined based on the response characteristic of the liquid crystal panel employed. Next, the WRGB displayable range is converted to the RGB displayable range. Furthermore, a conversion from the RGB color space to the L*a*b* color space is performed on the data representing the RGB displayable range according to equations (1) to (6) described above. As a result, an L*a*b* displayable range is determined. The data representing the L*a*b* displayable range determined in the above-described manner is the displayable range data according to the present embodiment.

<3.2.2 Tristimulus Value-Digital Gradation Value Conversion Unit>

The tristimulus value-digital gradation value conversion unit 124 convers the tristimulus value data R', G', and B' given from the minimum responsive color difference data correction unit 122 to digital gradation data that is data capable of being input to the liquid crystal panel 400 and that corresponds to one of fields (the white color field, the red color field, the green color field, and the blue color field) forming one frame period. In the present embodiment, unlike the first embodiment, the tristimulus value data R', G', and B' is converted by the tristimulus value-digital gradation value conversion unit 124 to white color digital gradation data w, red color digital gradation data r, green color digital gradation data g, and blue color digital gradation data b. That is, the tristimulus value data is converted to digital gradation data of four colors.

Figure 18:
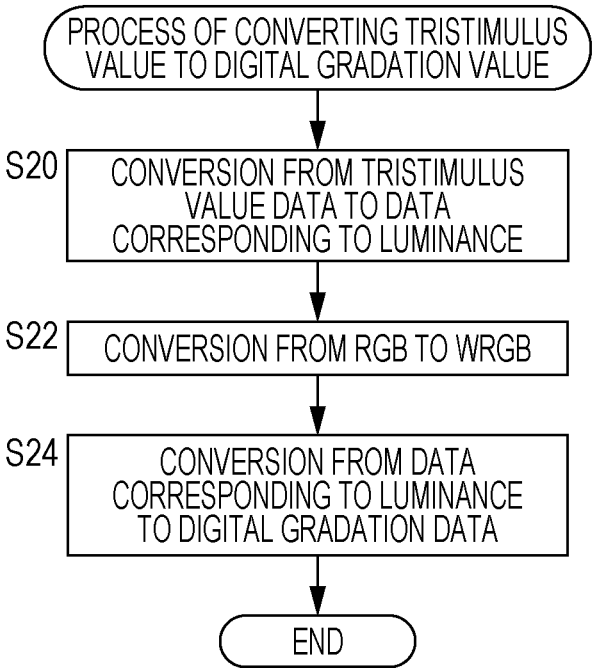
FIG. 18 is a flow chart illustrating a procedure of a tristimulus value-digital gradation value conversion process according to the third embodiment.

Now, the process (tristimulus value-digital gradation value conversion process) performed by the tristimulus value-digital gradation value conversion unit 124 is described in further detail below. FIG. 18 is a flow chart illustrating a procedure of the tristimulus value-digital gradation value conversion process. In the tristimulus value-digital gradation value conversion process, first, a process is performed to convert the tristimulus value data R', G', and B' output from the minimum responsive color difference data correction unit 122 to data corresponding to luminance (normalized values) (step S20). Let Rs, Gs, and Bs respectively denote a red color component, a green color component, and a blue color component of normalized values. Then Rs, Gs, and Bs are respectively determined according to equations (17), (18), and (19) shown below.

$$Rs=(R'-R\min)/R\max \quad (17)$$

$$Gs=(G'-G\min)/G\max \quad (18)$$

$$Bs=(B'-B\min)/B\max \quad (19)$$

where Rmax, Gmax, and Bmax respectively denote a red color component value, a green color component value, and a blue color component value, each having a maximum luminance, of the tristimulus values, and Rmin, Gmin, and Bmin respectively denote a red color component value, a green color component value, and a blue color component value, each having a minimum luminance, of the tristimulus values.

Next, the RGB combination of the normalized values Rs, Gs, and Bs, is converted to a WRGB combination (step S22). That is, a process is performed to convert data including the red color component, the green color component, and the blue color component to data including a white color component, a red color component, a green color component, and a blue color component. In the present embodiment, the value of the white color component is determined such that the value of the white color component is equal to the value of the smallest one of the red color component, the green color component, and the blue color component. Thereafter, a converted value of each color component is given by a difference between the value of the white color component and the original unconverted value of the color component.

Figure 19:
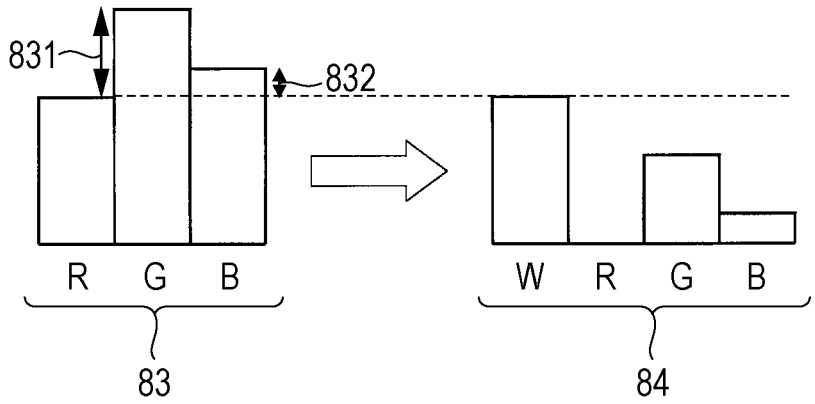
FIG. 19 is a diagram for illustrating a conversion from an RGB value to WRGB value according to the third embodiment.
Figure 20:
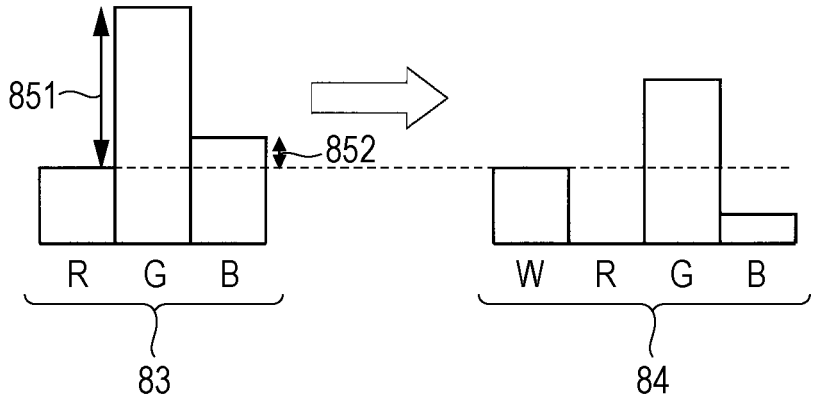
FIG. 20 is a diagram for illustrating a conversion from an RGB value to a WRGB value according to the third embodiment.

For example, let it be assumed that respective color components are as denoted by reference numeral 83 in FIG. 19 before the conversion is performed. In this example, the red color component is the least component among the red color component, the green color component, and the blue color component. Thus, the value of the white color component is determined so as to be equal to the original unconverted value of the red color component. Furthermore, the converted value of the green color component is determined as denoted by reference numeral 831 in FIG. 19, and the converted value of the blue color component is determined as denoted by reference numeral 832 in FIG. 19. Note that the converted value of the red color component is determined to be equal to 0. As a result, after the conversion, the respective color components are as denoted by reference numeral 84 in FIG. 19. As another example, let it be assumed that respective color components are as denoted by reference numeral 85 in FIG. 20 before the conversion is performed. In this example, the red color component is the least component among the red color component, the green color component, and the blue color component. Therefore, the value of the white color component is determined so as to be equal to the original unconverted value of the red color component. Furthermore, the converted value of the green color component is determined as denoted by reference numeral 851 in FIG. 20, and the converted value of the blue color component is determined as denoted by reference numeral 852 in FIG. 20. Note that the converted value of the red color component is determined to be equal to 0. As a result, after the conversion, the respective color components are as denoted by reference numeral 85 in FIG. 20.

Thus, the value Wa of the white color component, the value Ra of the red color component, the value Ga of the green color component, and the value Ba of the blue color component are respectively determined according to equations (20), (21), (22), and (23) as shown below.

$$Wa=C \quad (20)$$

$$Ra=Rs-C \quad (21)$$

$$Ga=Gs-C \quad (22)$$

$$Ba=Bs-C \quad (23)$$

Here if a function representing a minimum value of x, y, and z is denoted by min(x, y, z), then in the example described above, C=min(Rs, Gs, Bs). Note that, alternatively, Wa, Ra, Ga, and Ba may be determined under the condition C min(Rs, Gs, Bs).

After step S22 is completed, a process is performed to convert Wa, Ra, Ga, and Ba described above to digital gradation values (step S24). In this step S24, the white color digital gradation data w, the red color digital gradation data r, the green color digital gradation data g, and the blue color digital gradation data b, described above, are determined. In the present embodiment, under the assumption that the gamma value of the liquid crystal panel 400 is 2.2, the white color digital gradation data w, the red color digital gradation data r, the green color digital gradation data g, and the blue color digital gradation data b are respectively determined according to equations (24), (25), (26), and (27) shown below.

[Math. 9]

$$w=Wa^{0.45}\times 255 \quad (24)$$

[Math. 10]

$$r=Ra^{0.45}\times 255 \quad (25)$$

[Math. 11]

$$g=Ga^{0.45}\times 255 \quad (26)$$

[Math. 12]

$$b=Ba^{0.45}\times 255 \quad (27)$$

Thus in the tristimulus value-digital gradation value conversion unit 124, the tristimulus value data is converted to the digital gradation data in the manner described above. Note that the method described above is merely an example, and the present invention is not limited to this method. For example, equations (24) to (27) described above are dependent on the gamma value of the liquid crystal panel employed.

<3.2.3 Digital Gradation Data Correction Unit>

The digital gradation data correction unit for white color field 126(W) receives the white color digital gradation data w and the blue color digital gradation data b, and performs the correction for over driving on the white color digital gradation data w depending on the value (gradation value) of the blue color digital gradation data b. The digital gradation data correction unit for red color field 126(R) receives the red color digital gradation data r and the white color digital gradation data w, and performs the correction for over driving on the red color digital gradation data r depending on the value (gradation value) of the white color digital gradation data w. The digital gradation data correction unit for green color field 126(G) and the digital gradation data correction unit for blue color field 126(B) operate in a similar manner to the first embodiment. The gradation values are corrected by the respective digital gradation data correction units 126 in a similar manner to the first embodiment.

<3.3 Advantageous Effects>

In the present embodiment, as in the first embodiment, in the liquid crystal display device of the field sequential system, a data value of a color incapable of being displayed is corrected such that a corrected data value has a smallest color shift. Furthermore, in the present embodiment, one frame period includes one white color field, one red color field, one green color field, and one blue color field. That is, one frame period includes three fields in each of which a corresponding one of three primary colors is displayed, and further includes a filed in which a mixed color component of the three primary colors is displayed. This suppressed an occurrence of a color break. Thus it is possible to realize a liquid crystal display device of the field sequential system capable of suppressing an occurrence of a color break as well as suppressing an occurrence of a color shift.

<3.4 Modifications>

Figure 21:
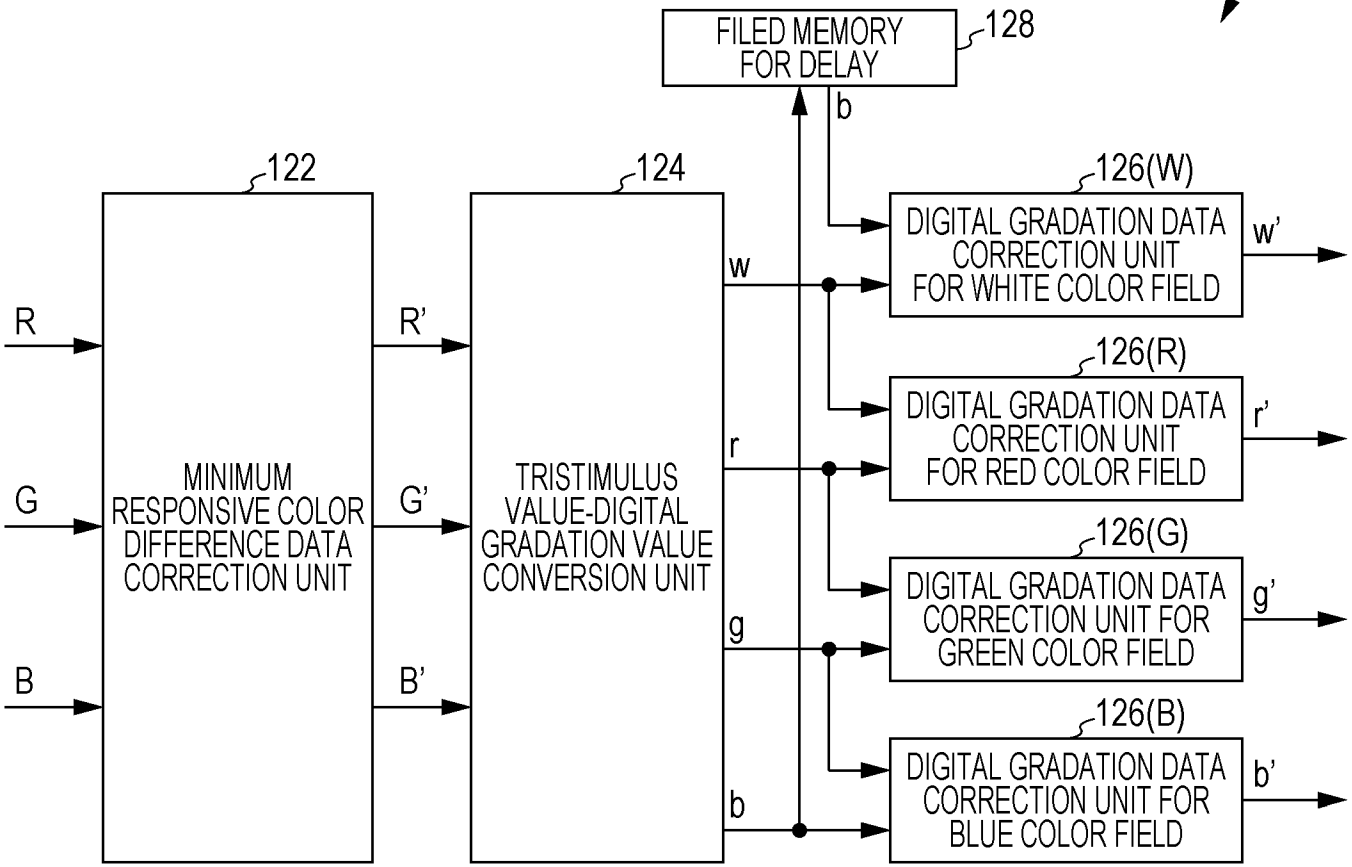
FIG. 21 is a block diagram illustrating a configuration of a data correction circuit according to a modification to the third embodiment.
Figure 22:
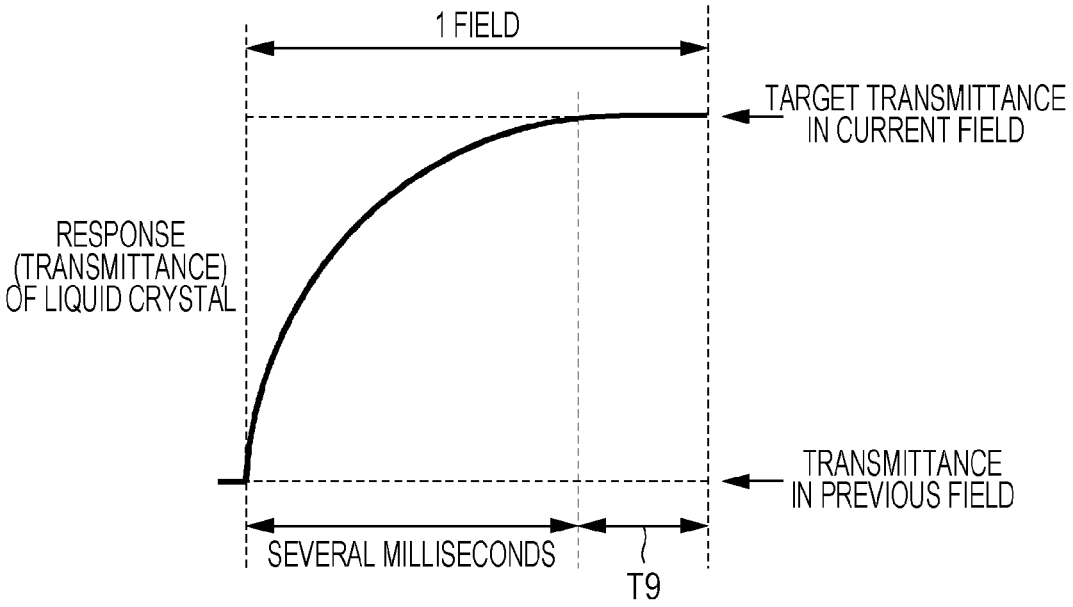
FIG. 22 is a schematic diagram for illustrating a response of a liquid crystal in a liquid crystal display device of the field sequential system.
Figure 23:
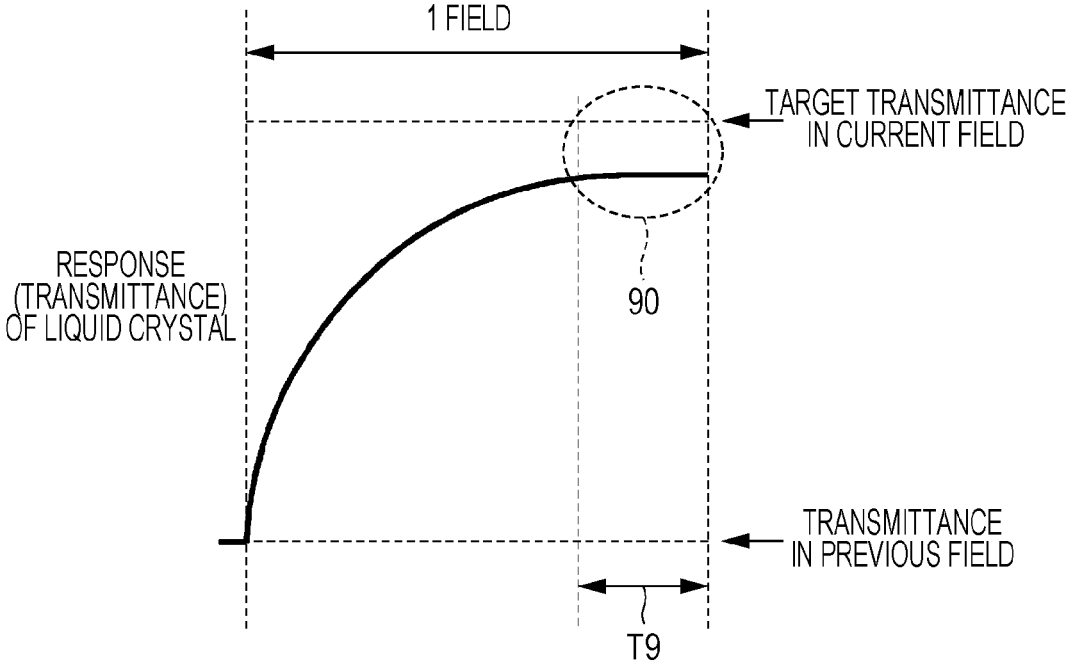
FIG. 23 is a diagram for illustrating a situation in which a target transmittance is not reached within one field in a liquid crystal display device of the field sequential system.
Figure 24:
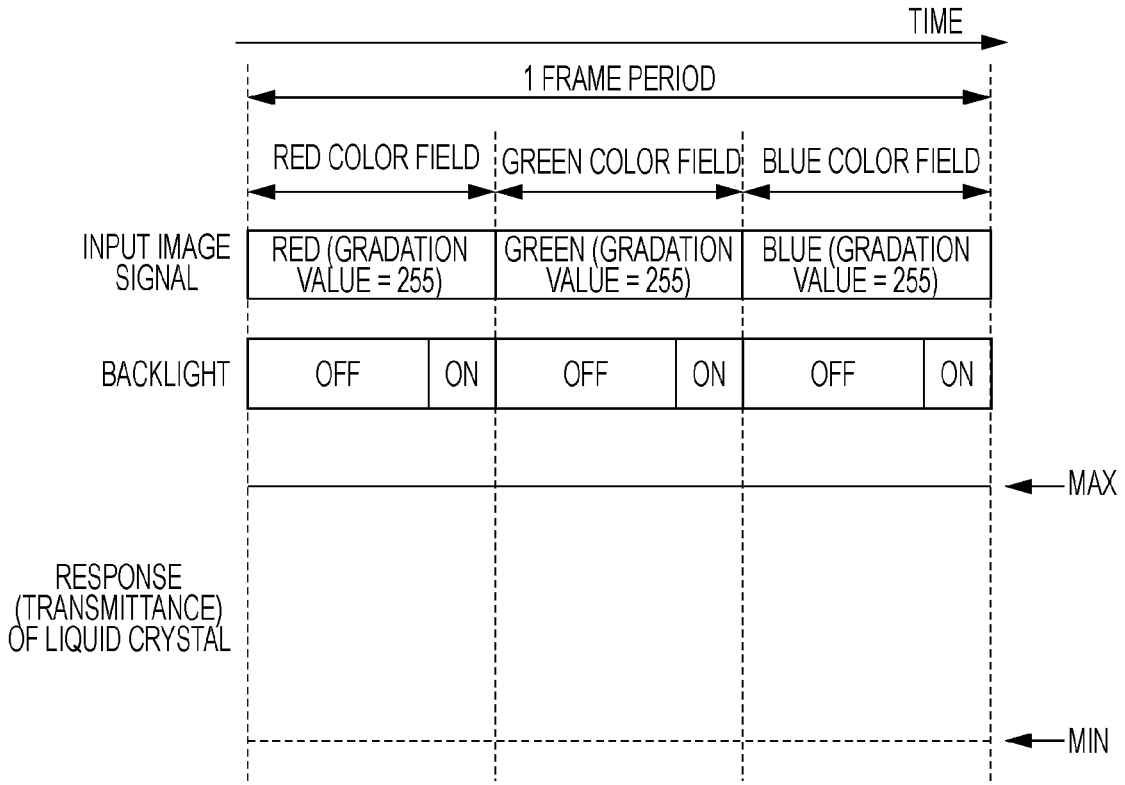
FIG. 24 is a diagram illustrating a phenomenon that occurs when a white color image is displayed on a liquid crystal display device of the field sequential system.

In the third embodiment described above, the data correction circuit 120 is configured as illustrated in FIG. 17. Alternatively, from a point of view similar to that in the second embodiment, the data correction circuit 120 may further include a delay field memory 128 as illustrated in FIG. 21. This makes it possible for the liquid crystal display device of the field sequential system not only to suppress an occurrence of a color break but also to suppress an occurrence of a color shift not only in displaying a still image but also in displaying a moving image.

Furthermore, in the third embodiment described above, to suppress an occurrence of a color break, one frame period is divided into one white color field, one red color field, one green color field, and one blue color field. However, the present invention is not limited to this. For example, one frame period is may be divided into one red color field, one green color field, one yellow color field, and one blue color field. Alternatively, for example, one frame period may divided into five fields.

<4. Others>

The present invention is not limited to the embodiments described above, but various modifications are possible without departing from the scope of the invention.

<5. Notes>

According to the present invention, the liquid crystal display device and the data correction method in the liquid crystal display device may be realized in various manners as described below.

(Note 1)

A liquid crystal display device of the field sequential system, configured to display a color by dividing one frame period into a plurality of fields and displaying different colors in the respective fields, includes a liquid crystal panel 400 configured to display an image, an RGB data correction unit 122 configured to receive pixel data that is data represented in an RGB color space and indicating a color of each pixel, and correct a data value of pixel data such that when a color given by a combination of R, G, and B is incapable of being displayed on the liquid crystal panel 400 by the field sequential system, the data value thereof is corrected to a data value of a color given by a combination of an R, G, and B capable of being displayed on the liquid crystal panel 400 by the field sequential system, a data conversion unit 124 configured to convert the pixel data corrected by the RGB data correction unit 122 to digital gradation data capable of being input to the liquid crystal panel 400 for each field, a digital gradation data correction unit 126 configured to correct the digital gradation data obtained in the data conversion unit 124 so as to emphasize a temporal change in a data value, a liquid crystal panel driving unit (200, 310, 320) configured to drive the liquid crystal panel 400 based on the digital gradation data corrected by the digital gradation data correction unit 126, wherein the RGB data correction unit 122 converts the pixel data represented in the RGB color space to data represented in an uniform color space, determines a color capable of being displayed in the uniform color space by the field sequential system such that the color has a smallest color difference from the original uncorrected color, converts the data representing the determined color to data represented in the RGB color space, and employs a resultant value obtained as a result of the conversion as a corrected data value of the pixel data.

In the liquid crystal display device of the field sequential system configured in the above-described manner, the data correction is performed as follows. First, pixel data represented in the RGB color space is converted into data represented in the uniform color space. Thereafter, for data of a color being incapable of being displayed by the field sequential system, a data value thereof is corrected such that a resultant corrected data value has a smallest color shift in the uniform color space. Thereafter, an inverse conversion is performed from the uniform color space to the RGB color space. Furthermore, pixel data obtained via the inverse conversion to the RGB color space is converted to digital gradation data, and this digital gradation data is subjected to a correction for over drive. As described above, for the data of the color incapable of being displayed by the field sequential system, the data value thereof is corrected so as to obtain a smallest color difference between the original uncorrected color and the corrected color in the color space suitable for calculating the color difference. This makes it possible to suppress an occurrence of a large color shift when a color image is displayed. Furthermore, use of over driving allows it to expand the displayable range compared to a case where the over driving is not performed. This makes it possible to further reduce the color difference between the original uncorrected color and the corrected color.

(Note 2)

In the liquid crystal display device described in Note 1, when an arbitrary field of the plurality of fields is defined as a field of interest, a data value of digital gradation data corresponding to the field of interest is defined as a value of the field being displayed, and a data value of digital gradation data corresponding to a field immediately previous to the field of interest is defined as a previous field value, the digital gradation data correction unit 126 corrects the value of the field being displayed obtained in the data conversion unit 124 depending on the previous field value obtained in the data conversion unit 124.

In this configuration, the amount of correction of the data value in the over driving (the difference between the uncorrected data value and the corrected data value) is determined depending on the data value in the immediately previous fields, and thus it becomes possible for the transmittance of each pixel to reach the target transmittance more accurately within each field. This suppresses the occurrence of the color shift in a more effective manner.

(Note 3)

The liquid crystal display device described in Note 2 further includes a field memory 128 capable of storing one field of digital gradation data corresponding to a last field in each frame period in the digital gradation data obtained in the data conversion unit 124.

In this configuration, when the correction for over driving is performed on data of a first field of each frame, it becomes possible to compare the data value in the first field of this frame with the data value in the last field of the immediately previous frame. Therefore, it becomes possible to effectively perform the correction for over driving on the data in the first field of each frame also when a moving image is displayed. As a result, in the liquid crystal display device of the field sequential system, an occurrence of a color shift is suppressed also in displaying moving images.

(Note 4)

The liquid crystal display device described in Note 2 further includes a look-up table 127 for determining a corrected value of the field being displayed based on the value of the field being displayed obtained in the data conversion unit 124 and the previous field value obtained in the data conversion unit 124, while the digital gradation data correction unit 126 corrects the value of the field being displayed obtained in the data conversion unit 124 according to the look-up table 127.

In this configuration, by storing data in advance in the look-up table 127 so as to make it possible to achieve effective over driving, it becomes possible for the transmittance of each pixel to reach the target transmittance more accurately within each field. This suppresses the occurrence of the color shift in a more effective manner.

(Note 5)

In the liquid crystal display device described in Note 4, the look-up table 127 stores only values corresponding to combinations of gradation values of part of all gradation values capable of being displayed by the liquid crystal panel 400, and in a case where the look-up table 127 does not include a value corresponding to a combination of the value of the field being displayed obtained in the data conversion unit 124 and the previous field value obtained in the data conversion unit 124, the digital gradation data correction unit 126 employs, as a corrected value of the field being displayed, a value obtained by a linear approximation using the look-up table 127 from two values close to the previous field value obtained in the data conversion unit 124 and two values close to the value of the field being displayed obtained in the data conversion unit 124.

By configuring the liquid crystal display device as described above, it becomes possible to suppress an increase in memory capacity necessary in performing the over driving.

(Note 6)

In the liquid crystal display device described in Note 1, the RGB data correction unit 122 may use an L*a*b* color space as the uniform color space.

By configuring the liquid crystal display device as described above, it becomes possible to relatively easily calculate the color difference of the corrected color from the original uncorrected color.

(Note 7)

In the liquid crystal display device described in Note 6, the RGB data correction unit 122 may perform data conversion between the RGB color space and the L*a*b* color space via an XYZ color space.

By configuring the liquid crystal display device as described above, it becomes possible to relatively easily perform the data conversion from the RGB color space to the L*a*b* color space.

(Note 8) In the liquid crystal display device described in Note 1, the plurality of fields may be three fields including a red color field in which a red color screen is displayed, a green color field in which a green color screen is displayed, and a blue color field in which a blue color screen is displayed, and the data conversion unit 124 may convert pixel data corrected by the RGB data correction unit 122 to digital gradation data corresponding to the red color field, digital gradation data corresponding to the green color field, and digital gradation data corresponding to the blue color field.

By configuring the liquid crystal display device as described above, it becomes possible for the liquid crystal display device of the field sequential system using a widely employed structure of one frame period to achieve an advantageous effect similar to that achieved in Note 1.

(Note 9)

In the liquid crystal display device described in Note 1, the plurality of fields may be four fields including a white color field in which a white color screen is displayed, a red color field in which a red color screen is displayed, a green color field in which a green color screen is displayed, and a blue color field in which a blue color screen is displayed, and the data conversion unit 124 may convert pixel data corrected by the RGB data correction unit 122 to digital gradation data corresponding to the white color field, digital gradation data corresponding to the red color field, digital gradation data corresponding to the green color field, and digital gradation data corresponding to the blue color field.

In this liquid crystal display device configured as described above, one frame period includes one white color field, one red color field, one green color field, and one blue color field. That is, one frame period includes three fields in each of which a corresponding one of three primary colors is displayed, and further includes a filed in which a mixed color component of the three primary colors is displayed. This suppressed an occurrence of a color break. Thus, it is possible to realize a liquid crystal display device of the field sequential system capable of suppressing an occurrence of a color break and suppressing an occurrence of a color shift.

(Note 10)

In the liquid crystal display device described in Note 9, the data conversion unit 124 may perform the conversion on the data of the color represented by the combination of R, G, and B given as the corrected pixel data by the RGB data correction unit 122 such that a value of digital gradation data corresponding to the white color field is set to be equal to a smallest value among values of R, G, and B and such that the values of the red color field, the green color field, and the blue color field are respectively set to be equal to differences between the corresponding original uncorrected values and the minimum value among R, G, and B.

By configuring the liquid crystal display device as described above, it is possible to realize a liquid crystal display device of the field sequential system capable of effectively suppressing an occurrence of a color break and suppressing an occurrence of a color shift.

(Note 11)

In the liquid crystal display device described in Note 1, the liquid crystal panel 400 may include a pixel electrode 41 arranged in the form of a matrix, a common electrode 44 disposed so as to oppose the one or more pixel electrodes 41, a liquid crystal 42 disposed between the pixel electrode 41 and the common electrode 44, a scanning signal line GL, an image signal line SL to which an image signal corresponding to the digital gradation data corrected by the digital gradation data correction unit 126 is applied, and a film transistor 40 including a control terminal connected to the scanning signal line GL, a first conduction terminal connected to the image signal line SL, a second conduction terminal connected to the pixel electrode 41, and a channel layer formed using an oxide semiconductor.

In the liquid crystal display device of the field sequential system configured in the above-described manner, the thin film transistor whose channel layer is formed using an oxide semiconductor is employed as the thin film transistor 40 disposed in the liquid crystal panel 400. This provides an advantage in terms of a high resolution and low power consumption, and a further advantage that it becomes possible to enhance the writing speed compared with a conventional writing speed. This makes it possible to suppress the occurrence of the color shift in a more effective manner.

(Note 12)

In the liquid crystal display device described in Note 11, the main components of the oxide semiconductor include indium (In), gallium (Ga), zinc (Zn), and (O).

In this liquid crystal display device configured in the above-described manner, use of indium gallium zinc oxide as the oxide semiconductor forming the channel layer ensures that advantageous effects similar to those achieved in the configuration described in Note 11 are achieved.

(Note 13)

A data correction method, in a liquid crystal display device of the field sequential system, including a liquid crystal panel 400 that displays an image and configured to display a color by dividing one frame period into a plurality of fields and displaying different colors in the respective fields, includes an RGB data correction step including receiving pixel data that is data represented in an RGB color space and indicating a color of each pixel, and correcting a data value of pixel data such that when a color given by a combination of R, G, and B is incapable of being displayed on the liquid crystal panel 400 by the field sequential system, the data value thereof is corrected to a data value of a color given by a combination of an R, G, and B capable of being displayed on the liquid crystal panel 400 by the field sequential system, a data conversion step including converting the pixel data corrected in the RGB data correction step to digital gradation data capable of being input to the liquid crystal panel for each field, a digital gradation data correction step including correcting the digital gradation data obtained in the data conversion step so as to emphasize a temporal change in a data value, and a liquid crystal panel driving step including driving the liquid crystal panel 400 based on the digital gradation data corrected in the digital gradation data correction step, wherein the RGB data correction step includes converting the pixel data represented in the RGB color space to data represented in an uniform color space, determining a color that is capable of being displayed in the uniform color space by the field sequential system and that has a smallest color difference from the uncorrected color, converting the data representing the determined color to data represented in the RGB color space, and employs a resultant value obtained as a result of the conversion as a corrected data value of the pixel data.

This data correction method makes it possible to achieve advantageous effects, similar to those achieved by the configuration described in Note 1, in the liquid crystal display device of the field sequential system.

REFERENCE SIGNS LIST

100 preprocessing unit
110 signal separation circuit
120 data correction circuit
122 minimum responsive color difference data correction unit
124 tristimulus value-digital gradation value conversion unit
126 digital gradation data correction unit
126(R), 126(G), 126(B), 126(W) digital gradation data correction unit for red color field, digital gradation data correction unit for green color field, digital gradation data correction unit for blue color field, digital gradation data correction unit for white color field
127 gradation value conversion look-up table
128 delay field memory
130(R), 130(G), 130(B), 130(W) red color field memory, green color field memory, blue color field memory, white color field memory
200 timing controller
310 gate driver
320 source driver
330 LED driver
400 liquid crystal panel
410 display unit
500 backlight

The invention claimed is:

1. A liquid crystal display device of a field sequential system that displays a color by dividing one frame period into a plurality of fields and displaying different colors in the respective fields, the liquid crystal display device comprising:

a liquid crystal panel that displays an image;

RGB data correction circuitry that receives pixel data that is data represented in an RGB color space and indicating a color of each pixel, corrects the pixel data to generate corrected pixel data, stores RGB displayable range data that represents a range defined by a set of RGB combinations, and achieves a target transmittance within one field;

data conversion circuitry that converts the corrected pixel data corrected by the RGB data correction circuitry to digital gradation data capable of being input to the liquid crystal panel for each field;

digital gradation data correction circuitry that corrects the digital gradation data obtained in the data conversion circuitry to corrected digital gradation data so as to emphasize a temporal change in a data value; and liquid crystal panel driving circuitry that drives the liquid crystal panel based on the corrected digital gradation data corrected by the digital gradation data correction circuitry, wherein when the pixel data is outside the RGB displayable range, the RGB data correction circuitry converts the pixel data represented in the RGB color space to data represented in a uniform color space, determines a color such that the color has a smallest color difference between the color and a corrected color within the RGB displayable range, converts the data representing the determined color to data represented in the RGB color space, and employs a resultant data obtained as a result of the conversion as the corrected pixel data, and when the pixel data is within the RGB displayable range, the RGB data correction circuitry uses the pixel data as the corrected pixel data.

2. The liquid crystal display device according to claim 1, wherein when an arbitrary field of the plurality of fields is defined as a field of interest, a data value of digital gradation data corresponding to the field of interest is defined as a value of the field being displayed, and a data value of digital gradation data corresponding to a field immediately previous to the field of interest is defined as a previous field value, the digital gradation data correction circuitry corrects the value of the field being displayed obtained in the data conversion circuitry depending on the previous field value obtained in the data conversion circuitry.

3. The liquid crystal display device according to claim 2, wherein the liquid crystal display device of the field sequential system further includes a field memory capable of storing one field of digital gradation data corresponding to a last field in each frame period in the digital gradation data obtained in the data conversion circuitry.

4. The liquid crystal display device according to claim 2, further comprising a look-up table that determines a corrected value of the field being displayed based on the value of the field being displayed obtained in the data conversion circuitry and the previous field value obtained in the data conversion circuitry, wherein the digital gradation data correction circuitry corrects the value of the field being displayed obtained in the data conversion circuitry according to the look-up table.

5. The liquid crystal display device according to claim 4, wherein the look-up table stores only values corresponding to combinations of gradation values of a portion of all gradation values capable of being displayed by the liquid crystal panel, and wherein in a case where the look-up table does not include a value corresponding to a combination of the value of the field being displayed obtained in the data conversion circuitry and the previous field value obtained in the data conversion circuitry, the digital gradation data correction circuitry employs, as a corrected value of the field being displayed, a value obtained by a linear approximation using the look-up table from two values close to the previous field value obtained in the data conversion circuitry and two values close to the value of the field being displayed obtained in the data conversion circuitry.

6. The liquid crystal display device according to claim 1, wherein the RGB data correction circuitry uses an L*a*b* color space as the uniform color space.

7. The liquid crystal display device according to claim 6, wherein the RGB data correction circuitry performs the data conversion between the RGB color space and the L*a*b* color space via an XYZ color space.

8. The liquid crystal display device according to claim 1, wherein the plurality of fields are three fields including a red color field in which a red color screen is displayed, a green color field in which a green color screen is displayed, and a blue color field in which a blue color screen is displayed, and wherein the data conversion circuitry converts pixel data corrected by the RGB data correction circuitry to digital gradation data corresponding to the red color field, digital gradation data corresponding to the green color field, digital gradation data corresponding to the blue color field.

9. The liquid crystal display device according to claim 1, wherein the plurality of fields may be four fields including a white color field in which a white color screen is displayed, a red color field in which a red color screen is displayed, a green color field in which a green color screen is displayed, and a blue color field in which a blue color screen is displayed, and wherein the data conversion circuitry may convert pixel data corrected by the RGB data correction circuitry to digital gradation data corresponding to the white color field, digital gradation data corresponding to the red color field, digital gradation data corresponding to the green color field, and digital gradation data corresponding to the blue color field.

10. The liquid crystal display device according to claim 9, wherein the data conversion circuitry performs the conversion on the data of the color represented by the combination of R, G, and B given as the corrected pixel data by the RGB data correction circuitry such that a value of digital gradation data corresponding to the white color field is set to be equal to a smallest value among values of R, G, and B and such that the values of the red color field, the green color field, and the blue color field are respectively set to be equal to differences between the corresponding original uncorrected values and the minimum value among R, G, and B.

11. The liquid crystal display device according to claim 1, wherein the liquid crystal panel includes one or more pixel electrodes arranged in the form of a matrix, a common electrode disposed so as to oppose the one or more pixel electrodes, a liquid crystal disposed between each of the one or more pixel electrodes and the common electrode, one or more scanning signal lines, one or more image signal lines to each of which an image signal corresponding to the digital gradation data corrected by the digital gradation data correction circuitry is applied, and one or more thin film transistors each including a control terminal connected to one of the scanning signal lines, a first conduction terminal connected to one of the image signal lines, a second conduction terminal connected to one of the pixel electrodes, and a channel layer formed using an oxide semiconductor.

12. The liquid crystal display device according to claim 11, wherein the main components of the oxide semiconductor include indium (In), gallium (Ga), zinc (Zn), and (O).

13. A data correction method, in a liquid crystal display device of a field sequential system, that displays a color by dividing one frame period into a plurality of fields and displaying different colors in the respective fields, comprising:

an RGB data correction step including receiving pixel data that is data represented in an RGB color space and indicating a color of each pixel, correcting the pixel data to generate corrected pixel data, storing RGB displayable range data that represents a range given by a set of RGB combination, and achieving a target transmittance within one field, a data conversion step including converting the corrected pixel data corrected in the RGB data correction step to digital gradation data capable of being input to the liquid crystal panel for each field, a digital gradation data correction step including correcting the digital gradation data obtained in the data conversion step to corrected digital gradation data so as to emphasize a temporal change in a data value, and a liquid crystal panel driving step including driving the liquid crystal panel based on the corrected digital gradation data corrected in the digital gradation data correction step, wherein when the pixel data is outside the RGB displayable range, the RGB data correction step includes converting the pixel data represented in the RGB color space to data represented in an uniform color space, determining a color and that has a smallest color difference between the color, converting the data representing the determined color to data represented in the RGB color space, and employs a resultant data obtained as a result of the conversion as the corrected pixel data, and when the pixel data is within the RGB displayable range, the RGB data correction step uses the pixel data as the corrected pixel data.

14. A liquid crystal display device of a field sequential system that displays a color by dividing one frame period into a plurality of fields and displaying different colors in the respective fields, the liquid crystal display device comprising:

a liquid crystal panel that displays an image;

RGB data correction circuitry that receives pixel data that is data represented in an RGB color space and indicates a color of each pixel, and corrects a data value of pixel data such that when a color given by a combination of R, G, and B is incapable of being displayed on the liquid crystal panel by the field sequential system, the data value thereof is corrected to a data value of a color given by a combination of a R, G, and B capable of being displayed on the liquid crystal panel by the field sequential system;

data conversion circuitry that converts the pixel data corrected by the RGB data correction circuitry to digital gradation data capable of being input to the liquid crystal panel for each field;

digital gradation data correction circuitry that corrects the digital gradation data obtained in the data conversion circuitry so as to emphasize a temporal change in a data value; and liquid crystal panel driving circuitry that drives the liquid crystal panel based on the digital gradation data corrected by the digital gradation data correction circuitry, wherein the RGB data correction circuitry converts the pixel data represented in the RGB color space to data represented in a uniform color space, determines a color capable of being displayed in the uniform color space by the field sequential system such that the color has a smallest color difference from the original uncorrected color, converts the data representing the determined color to data represented in the RGB color space, and uses a resultant value obtained as a result of the conversion as a corrected data value of the pixel data, when an arbitrary field of the plurality of fields is defined as a field of interest, a data value of digital gradation data corresponding to the field of interest is defined as a value of the field being displayed, and a data value of digital gradation data corresponding to a field immediately previous to the field of interest is defined as a previous field value, the digital gradation data correction circuitry corrects the value of the field being displayed obtained in the data conversion circuitry depending on the previous field value obtained in the data conversion circuitry, the liquid crystal display device further comprising a look-up table to determine a corrected value of the field being displayed based on the value of the field being displayed obtained in the data conversion circuitry and the previous field value obtained in the data conversion circuitry, wherein the digital gradation data correction circuitry corrects the value of the field being displayed obtained in the data conversion circuitry according to the look-up table, the look-up table stores only values corresponding to combinations of gradation values of a portion of all gradation values capable of being displayed by the liquid crystal panel, and in a case where the look-up table does not include a value corresponding to a combination of the value of the field being displayed obtained in the data conversion circuitry and the previous field value obtained in the data conversion circuitry, the digital gradation data correction circuitry uses, as a corrected value of the field being displayed, a value obtained by a linear approximation using the look-up table from two values close to the previous field value obtained in the data conversion circuitry and two values close to the value of the field being displayed obtained in the data conversion circuitry.

* * * * *